US010791601B2

(12) United States Patent
Chang et al.

(10) Patent No.: US 10,791,601 B2
(45) Date of Patent: Sep. 29, 2020

(54) LIGHT-EMITTING DEVICE

(71) Applicant: EPISTAR CORPORATION, Hsinchu (TW)

(72) Inventors: Chao-Kai Chang, Hsinchu (TW); Chen-Yu Wang, Hsinchu (TW); Chang-Hseih Wu, Hsinchu (TW); Jai-Tai Kuo, Hsinchu (TW)

(73) Assignee: EPISTAR CORPORATION, Hsinchu (TW)

( * ) Notice: Subject to any disclaimer, the term of this patent is extended or adjusted under 35 U.S.C. 154(b) by 0 days.

(21) Appl. No.: 16/353,526

(22) Filed: Mar. 14, 2019

(65) Prior Publication Data

US 2019/0289685 A1 Sep. 19, 2019

Related U.S. Application Data

(60) Provisional application No. 62/643,039, filed on Mar. 14, 2018.

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 45/37*** | (2020.01) |
| ***H05B 45/10*** | (2020.01) |

(52) U.S. Cl.
CPC ..... *H05B 45/37* (2020.01); *H05B 45/10* (2020.01)

(58) Field of Classification Search
None
See application file for complete search history.

(56) References Cited

U.S. PATENT DOCUMENTS

| | | | | |
|---|---|---|---|---|
| 8,497,637 | B2 | 7/2013 | Liu | |
| 9,814,105 | B2 | 11/2017 | Chiu et al. | |
| 2013/0169177 | A1* | 7/2013 | Liao | G05F 1/10 315/200 R |
| 2013/0307428 | A1* | 11/2013 | Hattrup | H05B 33/0812 315/201 |
| 2016/0113077 | A1* | 4/2016 | Akiyama | H05B 33/0815 315/201 |

* cited by examiner

*Primary Examiner* — Anh Q Tran
(74) *Attorney, Agent, or Firm* — Patterson + Sheridan, LLP

(57) ABSTRACT

A light-emitting device has a stabilizing-current circuit, a current source having a high electron mobility transistor, and a light source electrically connected to the stabilizing-current circuit and the current source.

15 Claims, 18 Drawing Sheets

LIGHT-EMITTING DEVICE

CROSS-REFERENCE TO RELATED APPLICATIONS

This application claims the right of priority based on Provisional Application Ser. No. 62/643,039, filed on Mar. 14, 2018, which is incorporated by reference in its entirety.

TECHNICAL FIELD

The present disclosure relates to a light-emitting device, and more particularly to a light-emitting device including a current source of a high electron mobility transistor.

DESCRIPTION OF BACKGROUND ART

In recent years, light-emitting diode has gradually replaced cathode lamp or tungsten as light sources for various lighting systems because of good electro-optical conversion efficiency and small product volume. The advantages and disadvantages of these lighting systems depend on whether stable lighting can be provided. For lighting system with dimmable luminous intensity, it usually needs a circuit that does not flicker the lighting system at low luminance.

SUMMARY OF THE DISCLOSURE

A light-emitting device comprises a light source, a stabilizing-current circuit and a current source. The light source has a first terminal and a second terminal. The stabilizing-current circuit is connected with the first terminal. The stabilizing-current circuit has a first transistor connected with the light source. The current source is connected with the second terminal. The current source has a second transistor connected with the light source.

DETAILED DESCRIPTION OF THE PRESENT DISCLOSURE

Figure 1:
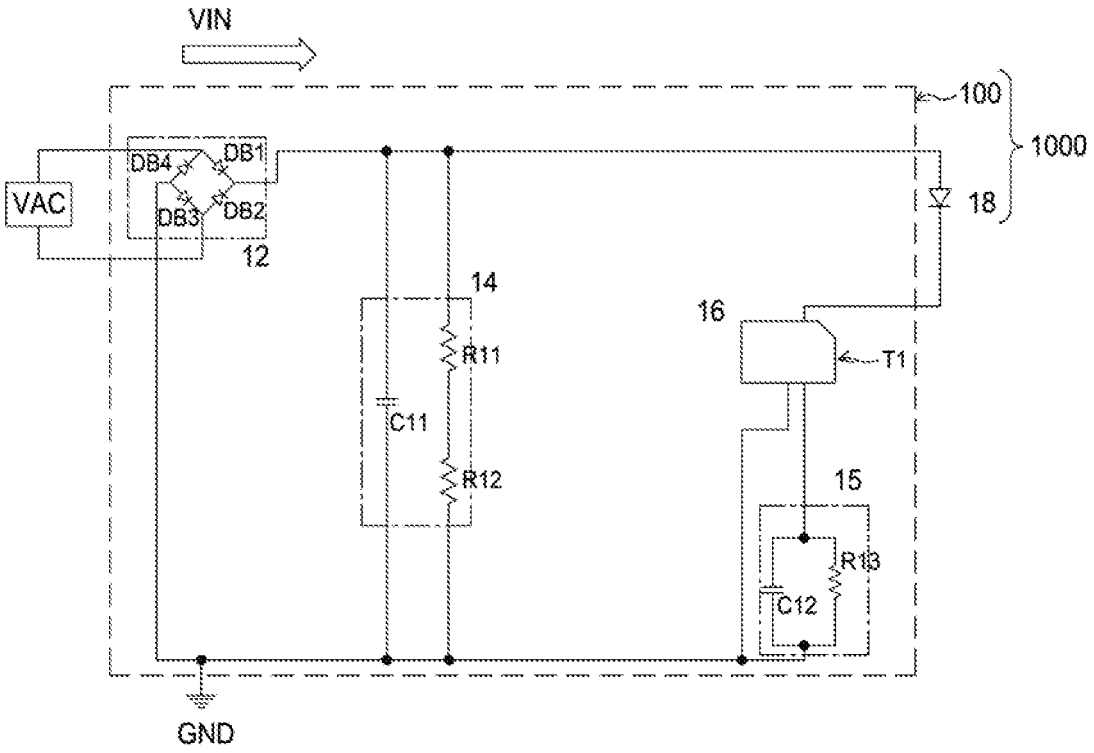
FIG. 1 is a circuit diagram of a light-emitting device in accordance with an embodiment of the present disclosure.

FIG. 1 is a circuit diagram of a light-emitting device in accordance with an embodiment of the present disclosure. Referring to FIG. 1, a light-emitting device 1000 includes a driving circuit 100 and a light source 18 having light-emitting diodes, and the light-emitting device 1000 is coupled to an power supply VAC to activate the light source 18. The power supply VAC is alternating current (AC) power source. The light source 18 can be a light source having endurance for high voltage. The light source 18 can also be formed by connecting a plurality of light-emitting diodes of the same or different sizes in series. For example, light source 18 includes two light-emitting diodes of the same size and connected in series, and the equivalent forward voltage of the light source 18 is 130 volts. The light-emitting diode include III-V group semiconductor material, such as $Al_xIn_yGa_{(1-x-y)}N$ or $Al_xIn_yGa_{(1-x-y)}P$, wherein $0 \le x, y \le 1$; $(x+y) \le 1$. Based on the material of the semiconductor material, the light-emitting diode can emit a red light with a peak wavelength or dominant wavelength of 610~650 nm; emit a green light with a peak wavelength or dominant wavelength of 530~570 nm; emit a blue light with a peak wavelength or dominant wavelength of 450~490 nm; emit a purple light with a peak wavelength or dominant wavelength of 400~440 nm, or emit a UV light with a peak wavelength of 200~400 nm. In an embodiment, the light-emitting diode further includes a wavelength conversion layer. The wavelength conversion layer includes one or more of phosphor, quantum dot material, or combinations thereof. The phosphor includes yellow-greenish phosphor, red phosphor, or blue phosphor. The yellow-greenish phosphor includes YAG, TAG, silicate, vanadate, alkaline-earth metal selenide, or metal nitride. The red phosphor includes fluoride ($K_2TiF_6:Mn^{4+}$, $K_2SiF_6:Mn^{4+}$), silicate, vanadate, alkaline-earth metal sulfide, oxynitride, or a mixture of tungstate and molybdate. The blue phosphor includes $BaMgAl_{10}O_{17}:Eu^{2+}$. The quantum dot material can be ZnS, ZnSe, ZnTe, ZnO, CdS, CdSe, CdTe, GaN, GaP, GaSe, GaSb, GaAs, AlN, AlP, AlAs, InP, InAs, Te, PbS, InSb, PbTe, PbSe, SbTe, ZnCdSeS, CuInS, $CsPbCl_3$, $CsPbBr_3$, $CsPbI_3$. In an embodiment, the light-emitting diode including a wavelength conversion material can emit a white light, wherein the white light has a color temperature between 10000K and 20000K, and has a color point coordinate (x, y) in the CIE 1931 chromaticity diagram, $0.27 \le x \le 0.285$; $0.23 \le y \le 0.26$. In one embodiment, the white light emitted by the light-emitting diode has a color temperature between 2200 and 6500K (for example, 2200K, 2400K, 2700K, 3000K, 5700K, 6500K) and has a color point coordinate (x, y) located in the 7-step MacAdam ellipse in the CIE1931 chromaticity diagram. In an embodiment, the equivalent forward voltage of the light source 18 is between 260 and 265 volts. In an embodiment, the light source 18 is a filament. The driving circuit 100 includes a bridge rectifier 12, a first filter 14, an electronic device 16 having a high electron mobility transistor (HEMT) T1 and a second filter 15. When the power supply VAC is activated, the input alternating current voltage is converted into an input voltage VIN via the bridge rectifier 12, and the electronic device 16 is turned on by the input voltage VIN and the light source 18 is turned on, so that the electronic device 16 is a current source to supply current to the light source 18. The input voltage VIN is direct current (DC) voltage signal.

The bridge rectifier 12 includes four diodes DB1-DB4 for converting the power supply VAC into the input voltage VIN. In an embodiment, the diodes DB1-DB4 are Schottky diodes. In an embodiment, the power supply VAC is 110V, 220V, or 230V. A first filter 14 is disposed between the bridge rectifier 12 and the light source 18. The first filter 14 is connected to the bridge rectifier 12, and has a capacitor C11 and two series-connected resistors R11 and R12. The first filter 14 can avoid sudden surges and the noise voltage directly into the light source 18, thereby avoiding damage or abnormal flicker caused by sudden surges and the noise voltage in the light source 18.

Two sides of the electronic device 16 are respectively connected to the light source 18 and the second filter 15. The electronic device 16 includes a high electron mobility transistor T1. The transistor T1 generates a current IDS to the light source 18 when it is turned on. The current IDS is a substantially constant current. In the case of conduction, the value of the current IDS is almost not changed under the variation of the voltage difference between the drain and the source. Therefore, the transistor T1 can provide a constant current to the light source 18. In an embodiment, the electronic device 16 includes two high electron mobility transistors electrically insulated from each other, and each of the two transistors can provide a constant current. The second filter 15 includes a resistor R13 and a capacitor C12 connected in parallel with each other, wherein the capacitor C12 can provide a voltage stabilizing effect and avoid flicker.

Figure 2A:
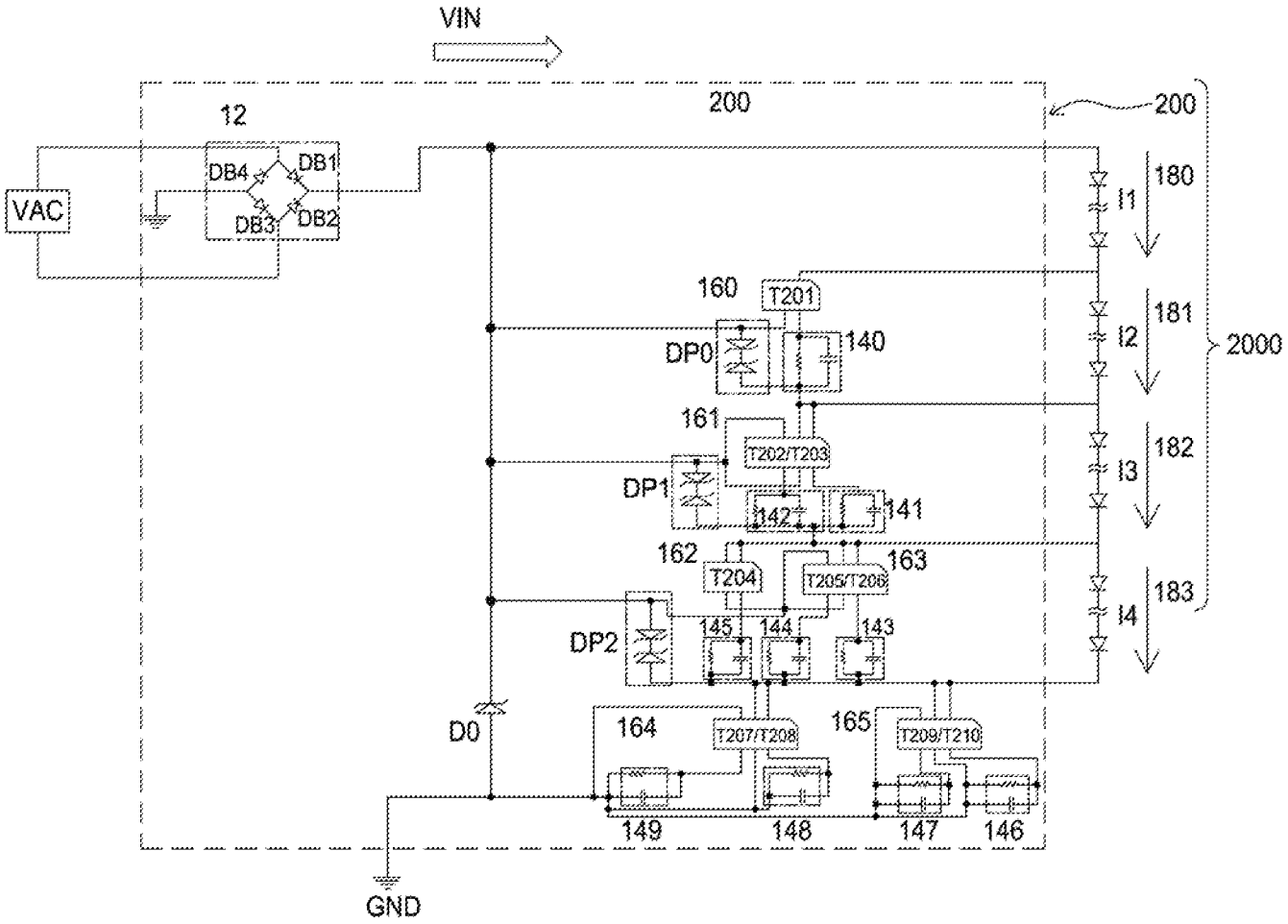
FIG. 2A is a circuit diagram of a light-emitting device in accordance with an embodiment of the present disclosure.

FIG. 2A is a circuit diagram of a light-emitting device in accordance with an embodiment of the present disclosure. Referring to FIG. 2A, the light-emitting device 2000 includes a driving circuit 200 and light sources 180-183 having light-emitting diodes. The light sources 180-183 can be a light source having endurance for high voltage. The light sources 180-183 can also be formed by connecting a plurality of light-emitting diodes of the same or different sizes in series. For example, light sources 180-183 respectively includes 24 light-emitting diodes of the same size and connected in series. The equivalent forward voltage of each light-emitting diode is 3 volts, therefore the respectively equivalent forward voltage of light sources 180-183 is 72 volts. In an embodiment, each of the light sources 180-183 is a filament. In an embodiment, the light-emitting device 2000 is a light-emitting device adapting DOB (Driver On Board) technology with both the driving circuit 200 and the light sources 180-183 disposed on the same board. The driving circuit 200 includes a bridge rectifier 12, filters 140-149, electronic devices 160-165, diode D0 and diode groups DP0, DP1, DP2. The electronic devices 160-165 include transistors such as high electron mobility transistors and are used as a current source for providing current to the light sources 180-183. The bridge rectifier 12 also converts the power supply VAC into an input voltage VIN. Related detailed descriptions can be referred to the above-mentioned paragraphs.

Referring to FIG. 2A, in the light-emitting device 2000, as the voltage of the power supply VAC increases, the input voltage VIN also increases and the light sources 180-183 are illuminated in sequence. More particularly, the input voltage VIN is increased enough to turn on the light source 180 but the light sources 181-183 are not illuminated. At this time, the current I1 flows through the light source 180 and the electronic devices 160-165 in sequence. The magnitude of the current I1 is limited by the electronic devices 160-165. In an embodiment, the current I1 is equal to the minimum value of the current supplied by the electronic devices 160-165. In another aspect, the electronic device includes a transistor that can be a high electron mobility transistor (HEMT). For example, the electronic device 160 includes a transistor T201, the electronic device 161 includes transistors T202 and T203, the electronic device 162 includes a transistor T204, the electronic device 163 includes transistors T205 and T206, the electronic device 164 includes transistors T207 and T208, and the electronic device 165 includes transistors T209 and T210.

As the input voltage VIN increases, the electronic device 160 is turned off, and the light sources 180, 181 are illuminated but the light sources 182, 183 are not illuminated. At this time, the current I2 flowing through the light source 181 is limited by the electronic devices 161-165. In an embodiment, the current I2 is equal to the maximum value of the current that can be supplied by the electronic device 161 under normal operation, or the maximum value of the sum of the currents that can be supplied by the transistors T202 and T203.

As the input voltage VIN increases again, the electronic devices 160, 161 are turned off, and the light sources 180-182 are illuminated but the light source 183 is not illuminated. At this time, the current I3 flowing through the light source 182 is limited by the electronic devices 162-165. In an embodiment, the current I3 is equal to the maximum value of the sum of the currents that can be supplied by the transistors T204-T206 under normal operation. When the input voltage VIN increases again, the electronic devices 160-163 are turned off, and the light sources 180-183 are illuminated. At this time, the current I4 flowing through the light source 183 is limited by the electronic devices 164 and 165. In an embodiment, the current I4 is equal to the maximum value of the sum of the currents that can be supplied by the transistors T207-T210 under normal operation. However, when the input voltage VIN gradually decreases, the electronic devices 160-165 are turned on in the sequence of the electronic devices 164-165, the electronic devices 162-163, the electronic device 161 and the electronic device 160. For example, the electronic devices 162-163 are turned on and then electronic device 161 is turned on as the input voltage VIN decreasing.

During the operation of the light-emitting device 2000, the electronic devices 160-165 are sequentially turned off as the input voltage increases, and then sequentially turned on in the reverse order as the input voltage decreases. In an embodiment, the input voltage is a DC power source that is variable in value. The current I1 is controlled by the transistor T201 of the electronic device 160, the current I2 is controlled by the transistors T202, T203 of the electronic device 161, the current I3 is controlled by the transistors T204-T206 of the electronic device 162 and 163, and the current I4 is controlled by the transistors T207-T210 of the electronic devices 164, 165. The current I2 is substantially averaged by the transistors T202 and T203.

The diode D0 is connected to the electronic devices 160-163. A fixed voltage existing between the two terminals of the diode D0 in the breakdown condition is provided to the electronic devices 160-163. More particularly, the diode D0 is connected to all the gates of the transistors of the electronic devices 160-163. In an embodiment, the diode D0 is a Zener diode. Each of the filters 140-149 is connected to each source of the transistors of the electronic devices 160-163 for filtering noise when the current passes through the electronic devices 160-163, thereby avoiding the light source 180-183 flickers due to noise. The filters 140-149 are similar to the filter 15, and each of filters 140-149 includes a resistor and a capacitor connected in parallel. The related descriptions can be referred to the above-mentioned paragraphs. The diode groups DP0, DP1, DP2 are connected to the electronic devices 160-163 and the filters 140-145 of the same electronic device 160-163. More particularly, each of the diode group DP0, DP1, DP2 has a first terminal and a second terminal. Each first terminal of the diode group DP0, DP1, DP2 is connected to each gate of the transistors of the electronic devices 160-163, and each second terminal of the diode group DP0, DP1, DP2 is connected to each source of the transistors of the electronic devices 160-163 through the filter 140-145. The diode groups DP0-DP2 are used to maintain the voltage between the gate and the source of the transistors of the electronic devices 160-163 not exceeding a certain value, for example, below 6.5 volts, to limit the operating range of the electronic device, thereby preventing the electronic device from generating excessive current to burn the light source or abnormally turning off the power to cause the flicker. Each of the diode groups DP0-DP2 respectively includes diodes in reverse series, such as Zener diodes in reverse series.

Figure 2B:
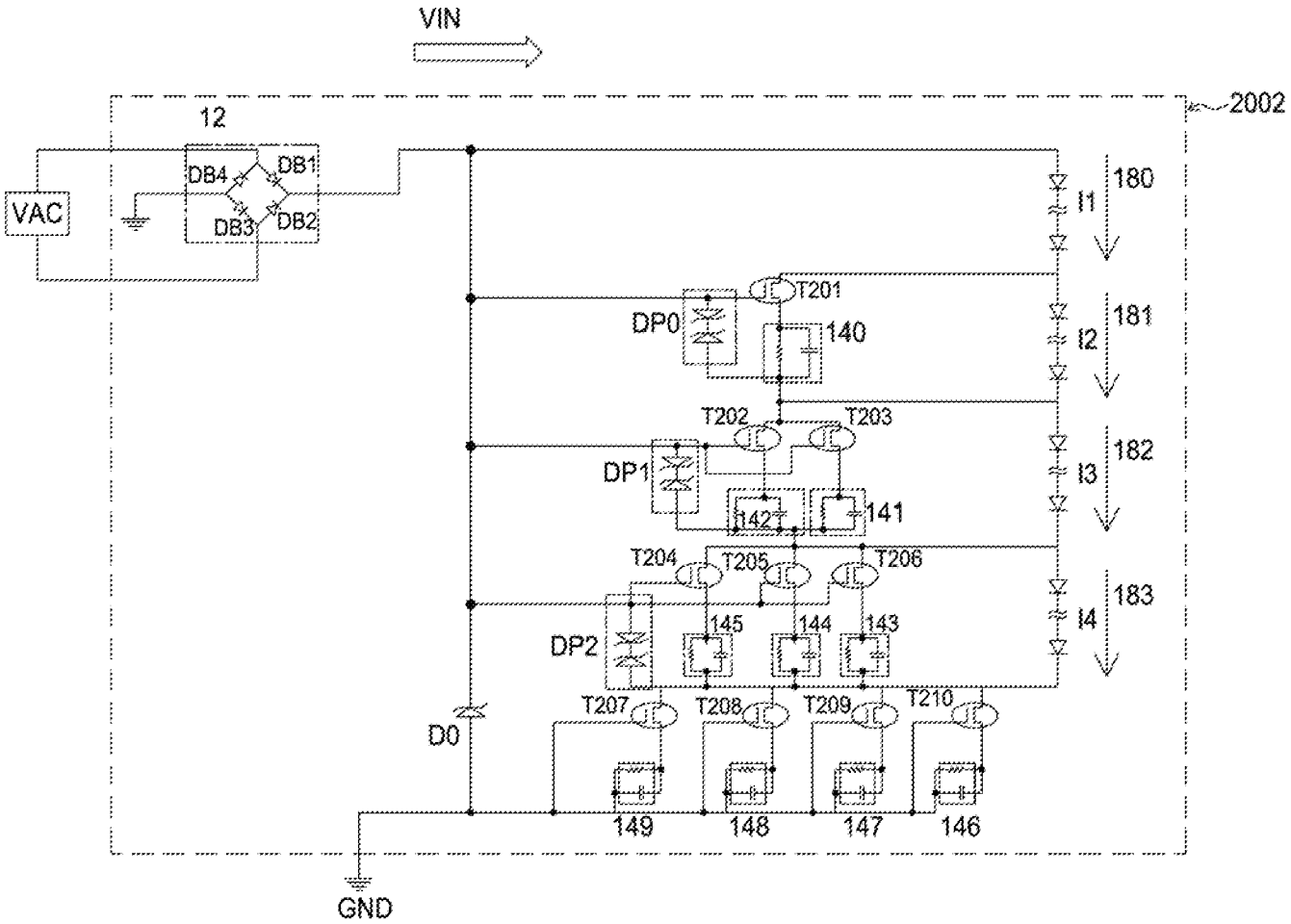
FIG. 2B is a circuit diagram of a light-emitting device in accordance with an embodiment of the present disclosure.

The electronic device may include one or more transistors, wherein the transistor may be a high electron mobility transistor (HEMT). FIG. 2B is a circuit diagram of a light-emitting device in accordance with an embodiment of the present disclosure. In FIG. 2B, the electronic devices 160-165 of FIG. 2A are replaced by transistors to form the light-emitting device 2002. For example, the electronic device 160 is replaced by the transistor T201, the electronic device 161 is replaced by the transistors T202 and T203, the electronic device 162 is replaced by the transistor T204, the electronic device 163 is replaced by the transistors T205 and T206, the electronic device 164 is replaced by the transistors T207 and T208, and the electronic device 165 is replaced by the transistors T209 and T210. More particularly, the gate of the transistor T201 is connected to the diode group DP0, the drain is connected to the light source 180, and the source is connected to the filter 140. The gates of the transistors T202 and T203 are connected to the diode group DP1, the two drains are also connected to the light source 181, the source of the transistor T202 is connected to the filter 142, and the source of the transistor T203 is connected to the filter 141. In addition, the electrical connection relationship between the transistor T204 and other components in the light-emitting device 2002 is similar to that of the electronic device 160, and the electrical connection relationship between the transistors T205-T210 and other components is similar to that of the electronic device 161. The related circuit operation can be referred to the above-mentioned paragraphs of FIG. 2A.

FIGS. 2C to 2F are waveform diagrams of a light-emitting device under different operation conditions in accordance with an embodiment of the present disclosure. These operation conditions are differentiated by different input conditions. More particularly, FIGS. 2C to 2F show the waveforms of a transient state when the light-emitting device of FIG. 2A or 2B is operated under different input conditions.

Figure 2C:
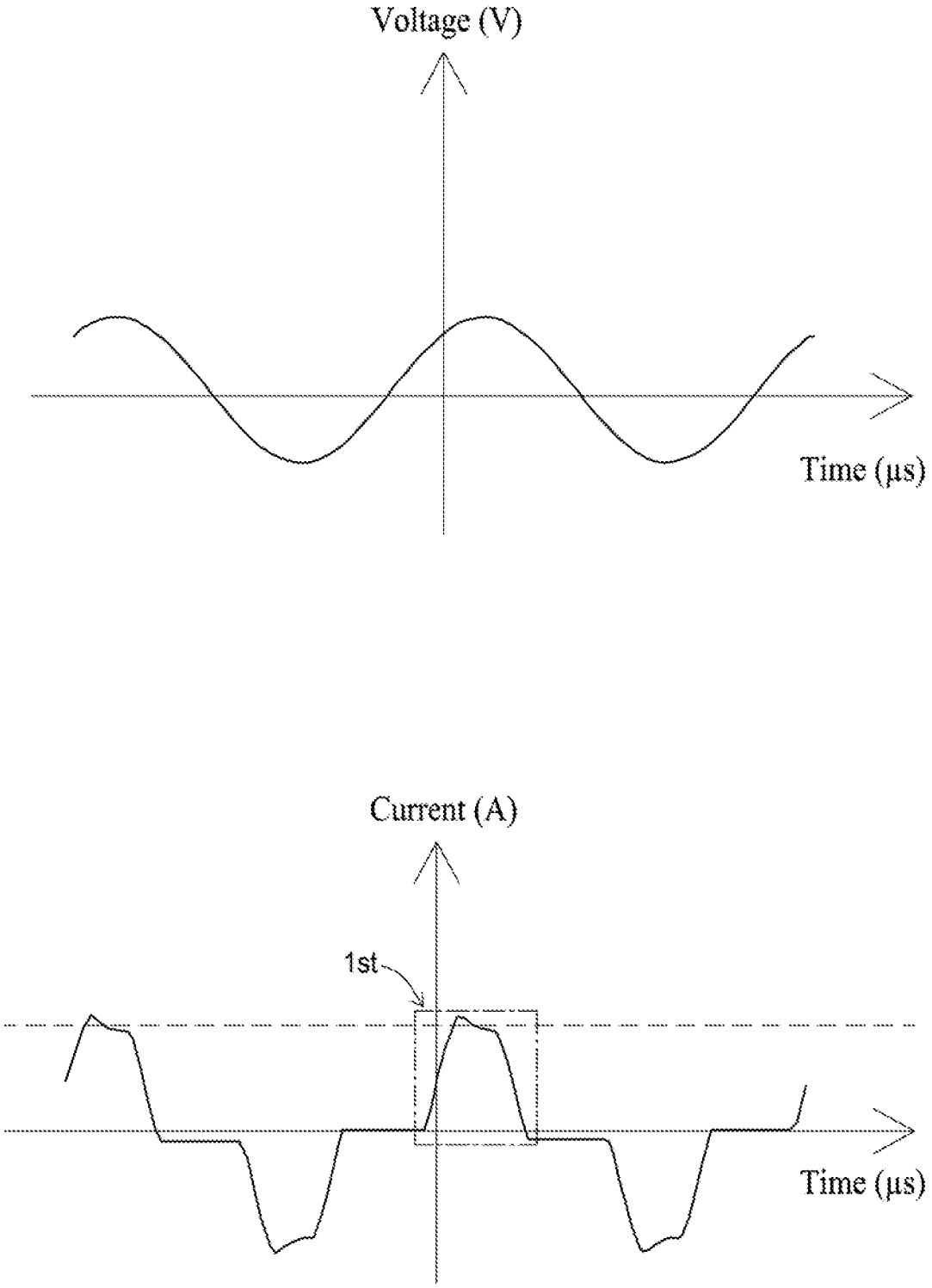
FIGS. 2C to 2F are waveform diagrams of a light-emitting device under different operation conditions in accordance with an embodiment of the present disclosure.

Referring to FIG. 2C, the root-mean-square (RMS) value of the voltage output from the power supply VAC is 69.7V, and the average output current is 89.2 mA. In FIG. 2C, the left-hand side diagram is the voltage waveform diagram and the right-hand side diagram is the current waveform diagram. Under the operation condition of FIG. 2C, only the light source 180 emits light, and the current I1 passes through the light source 180, the electronic device 160 (the transistor T201), the filter 140, the electronic device 161 (the transistors T202, T203), the filters 141 and 142, the electronic devices 162 and 163 (the transistors T204-T206), the filters 143-145, electronic devices 164 and 165 (the transistors T207-T210) and the filters 146-149. The 1st area in the figure indicates the current under the condition disclosed in FIG. 2C.

Figure 2D:
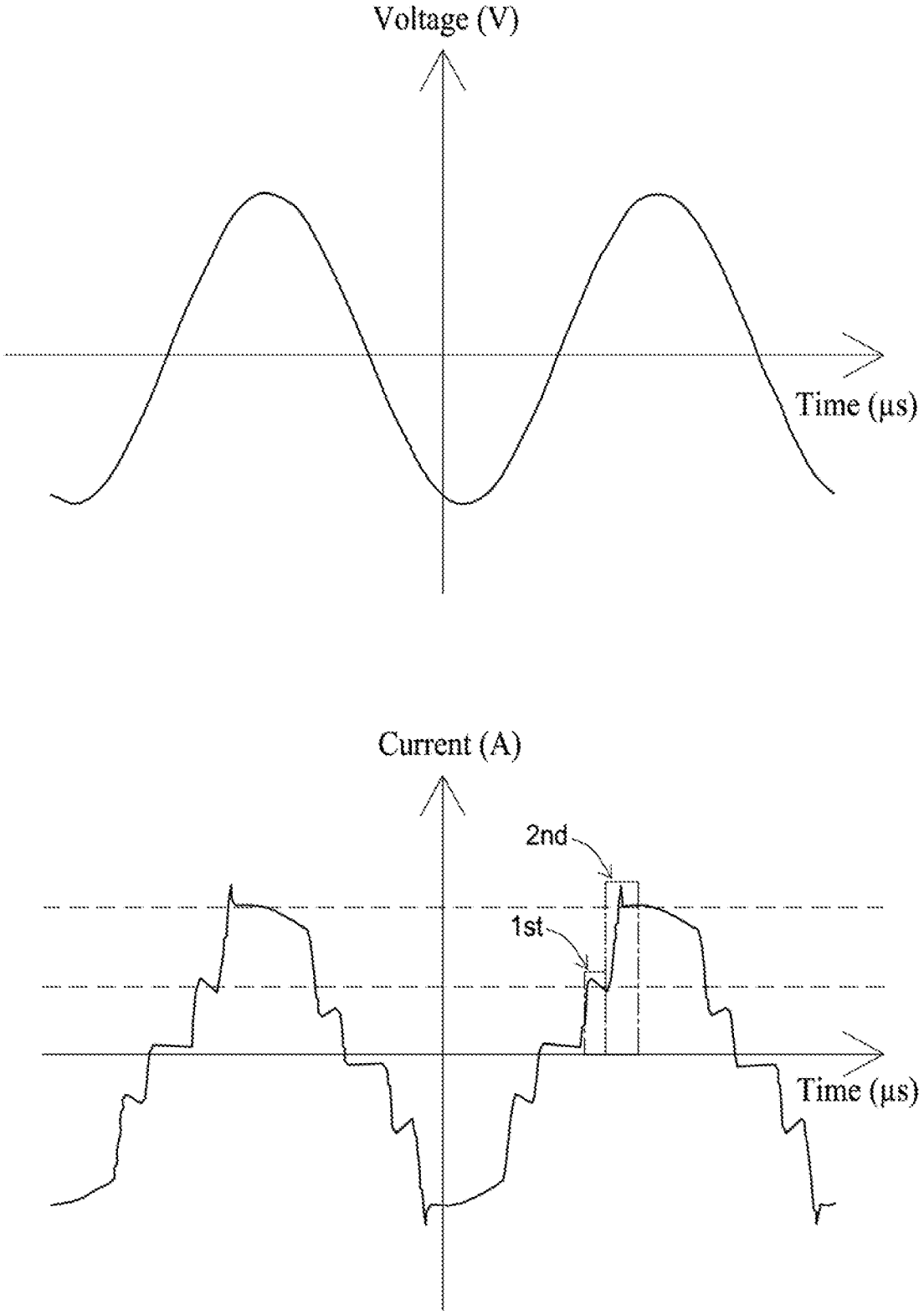

Referring to FIG. 2D, the RMS value of the voltage output from the power supply VAC is 140V, and the average output current is 131 mA. In FIG. 2D, the left-hand side diagram is the voltage waveform diagram and the right-hand side diagram is the current waveform diagram. Under the operation condition of FIG. 2D, the light sources 180 and 181 emit light and the electronic device 160 (the transistor T201) is turned off. The current I2 passes through the light sources 180 and 181, the electronic device 161 (the transistors T202, T203), the filters 141 and 142, the electronic devices 162 and 163 (the transistors T204-T206), the filters 143-145, the electronic devices 164 and 165 (the transistors T207-T210), and the filters 146-149.

In FIG. 2D, the RMS value of the voltage output from the power supply VAC is 140V. When the voltage output from the power supply VAC is gradually increased from a lower voltage (for example, 0V) to 140V, it goes through the voltage 69.7V output from the power supply VAC disclosed in FIG. 2C first. That means in a continuous boosting voltage process, the condition disclosed in FIG. 2C is occurred earlier than the condition disclosed in FIG. 2D. Such operation is also reflected in the waveform diagram. Referring to FIG. 2D, the 1st area in the figure indicates the current under the condition disclosed in FIG. 2C, and the 2nd area indicates the current under the condition disclosed in FIG. 2D.

Figure 2E:
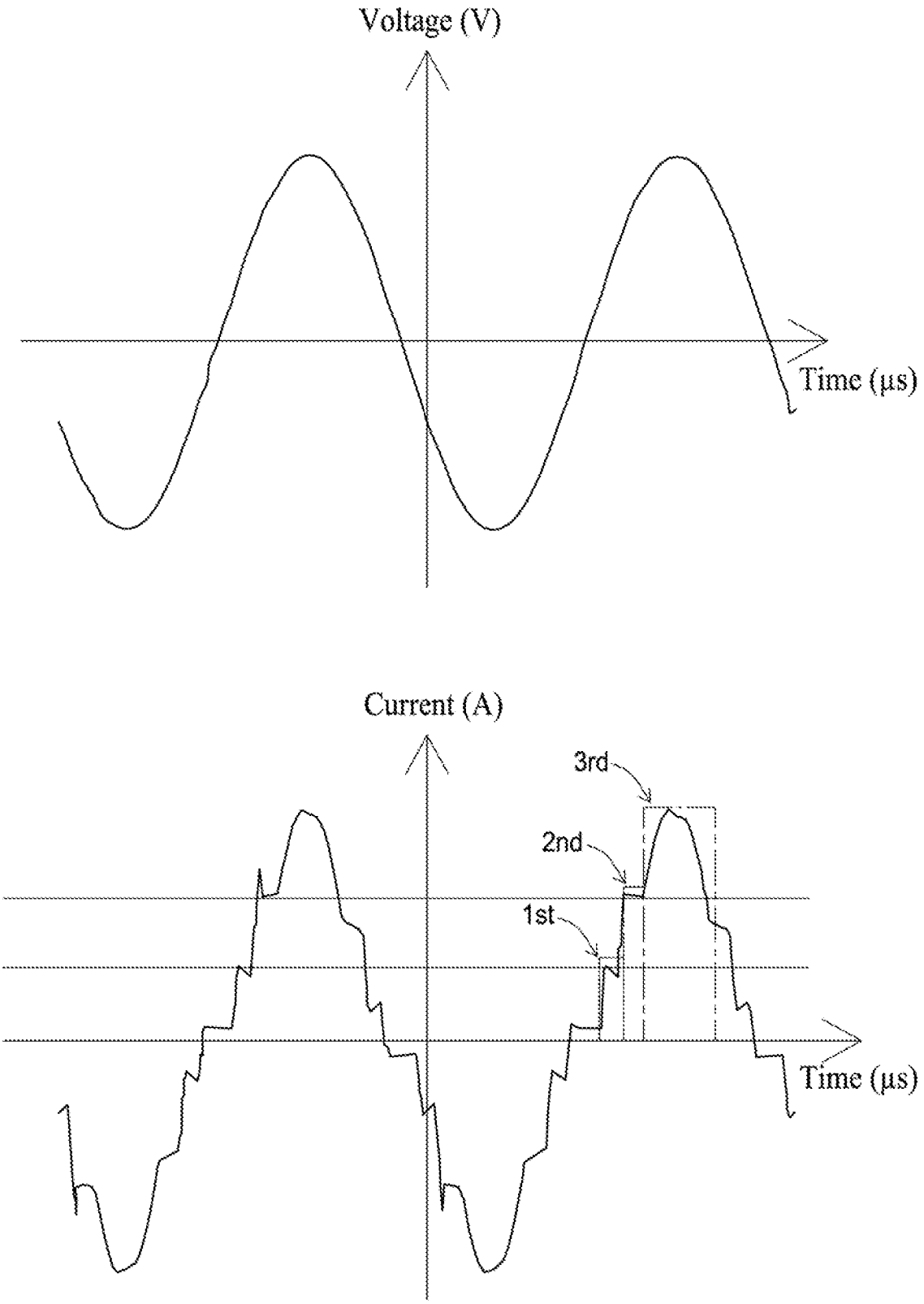

Referring to FIG. 2E, the RMS value of the voltage output from the power supply VAC is 180V, and the average output current is 190 mA. In FIG. 2E, the left-hand side diagram is the voltage waveform diagram and the right-hand side diagram is the current waveform diagram. Under the condition of FIG. 2E, the light sources 180-182 emit light and the electronic device 160 and 161 (the transistors T201-T203) are turned off. The current I3 passes through the light sources 180-182, the electronic devices 162 and 163 (the transistors T204-T206), the filters 143-145, the electronic devices 164 and 165 (the transistors T207-T210), and the filters 146-149.

Similarly, when the voltage output from the power supply VAC is gradually increased from a lower voltage to 180V, it goes through the voltage 69.7V and the voltage 140V respectively output from the power supply VAC disclosed in FIGS. 2C and 2D first. Therefore the conditions disclosed in FIGS. 2C and 2D will be occurred earlier than the condition disclosed in FIG. 2E. Referring to FIG. 2E, the 1st area in the figure indicates the current under the condition disclosed in FIG. 2C, the 2nd area indicates the current under the condition disclosed in FIG. 2D, and the 3rd area indicates the current under the condition disclosed in FIG. 2E.

Figure 2F:
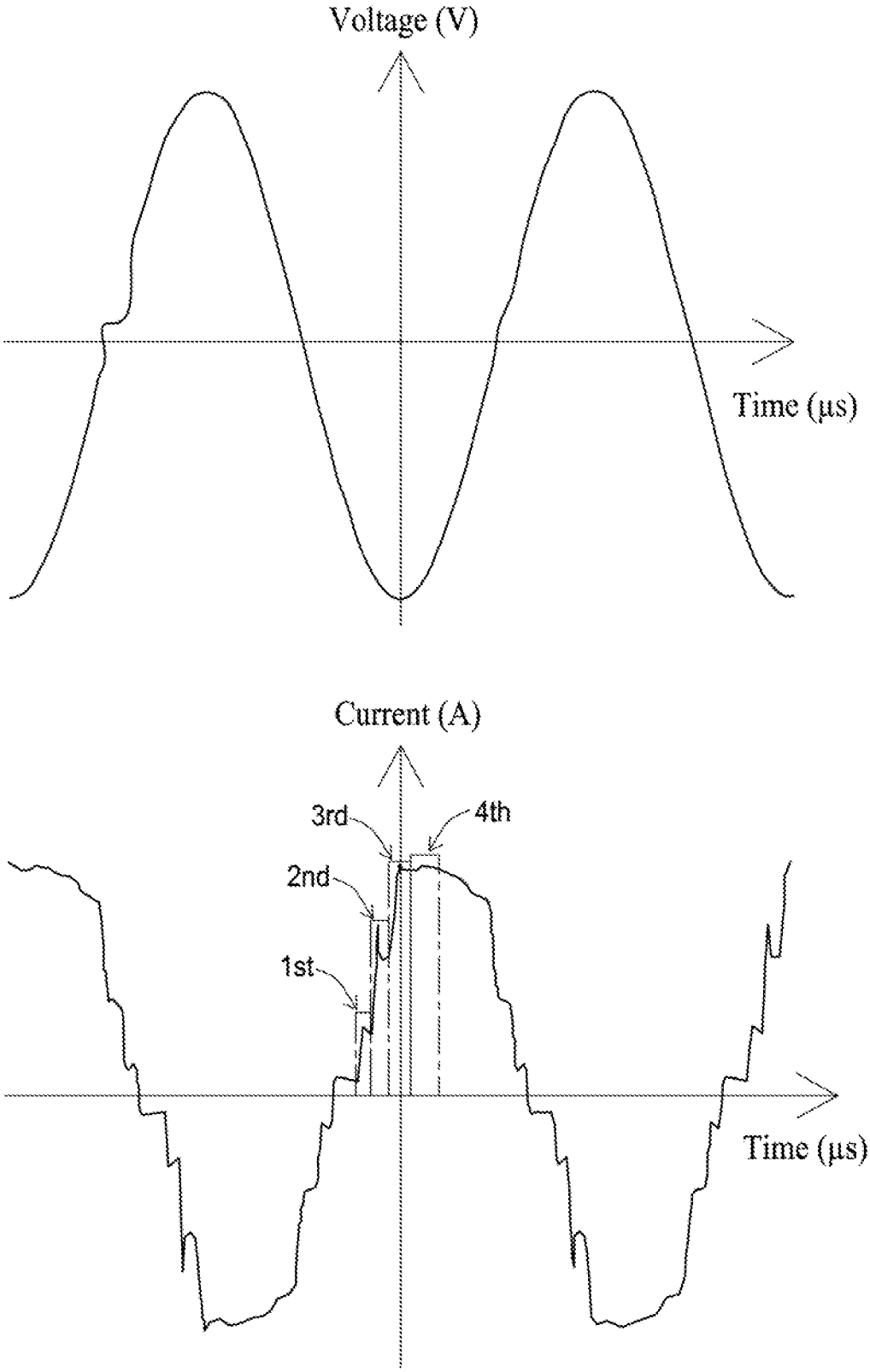

Referring to FIG. 2F, the RMS value of the voltage output from the power supply VAC is 230V, and the average output current is 218 mA. In FIG. 2F, the left-hand side diagram is the voltage waveform diagram and the right-hand side diagram is the current waveform diagram. Under the operation condition of FIG. 2F, the light sources 180-183 emit light and the electronic device 160-163 (the transistors T201-T206) are turned off. The current I4 passes through the light sources 180-183, the electronic devices 164 and 165 (the transistors T207-T210), and the filters 146-149.

Similarly, when the voltage output from the power supply VAC is gradually increased from a lower voltage to 230V, it goes through the conditions disclosed in FIG. 2C to 2E. Referring to FIG. 2F, the 1st area in the figure indicates the current under the condition disclosed in FIG. 2C, the 2nd area indicates the current under the condition disclosed in FIG. 2D, the 3rd area indicates the current under the condition disclosed in FIG. 2E, and the 4th area indicates the current under the condition disclosed in FIG. 2F. In contrast, when the voltage output from the power supply VAC is gradually decreased from the higher voltage, the electronic devices 160-163 are turned on in the sequence of the electronic devices 162-163, the electronic device 161 and the electronic device 160.

In general, the operation state of the light-emitting device is varied with the value of the input voltage. An operation state corresponding to a higher voltage output from the power supply VAC can be accompanied with an operation state corresponding to a lower voltage. For example, when observing the waveform of the 100V RMS value of the voltage output from the power supply VAC, the waveform of the 69.7V RMS value of the voltage output from the power supply VAC output in FIG. 2C can also be observed. When observing the waveform of the 175V RMS value of the voltage output from the power supply VAC, the waveform of the 69.7V RMS value of the voltage output from the power supply VAC output in FIG. 2C and the waveform of the 140V RMS value of the voltage output from the power supply VAC output in FIG. 2D can also be observed.

Figure 3A:
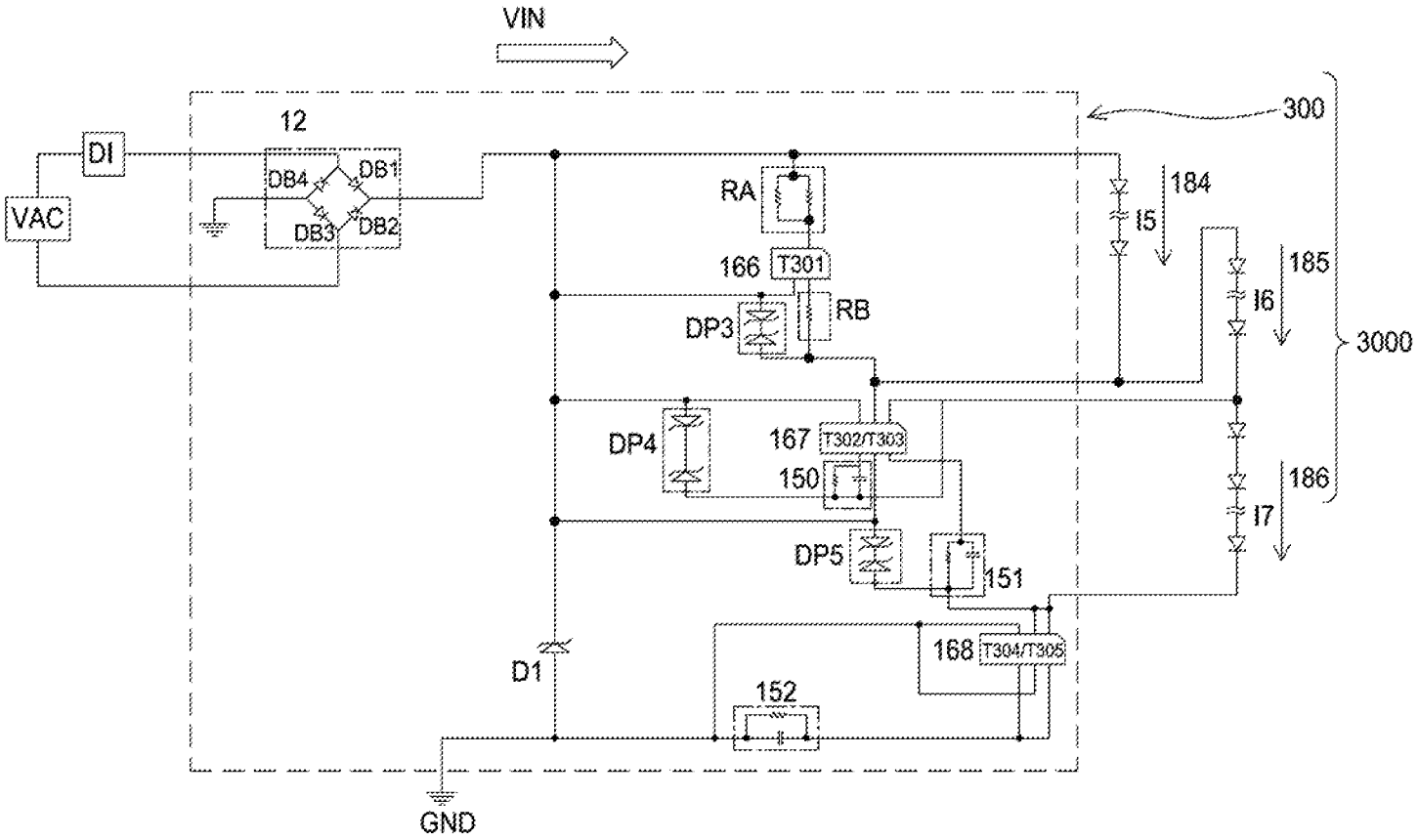
FIG. 3A is a circuit diagram of a light-emitting device in accordance with an embodiment of the present disclosure.
Figure 3B:
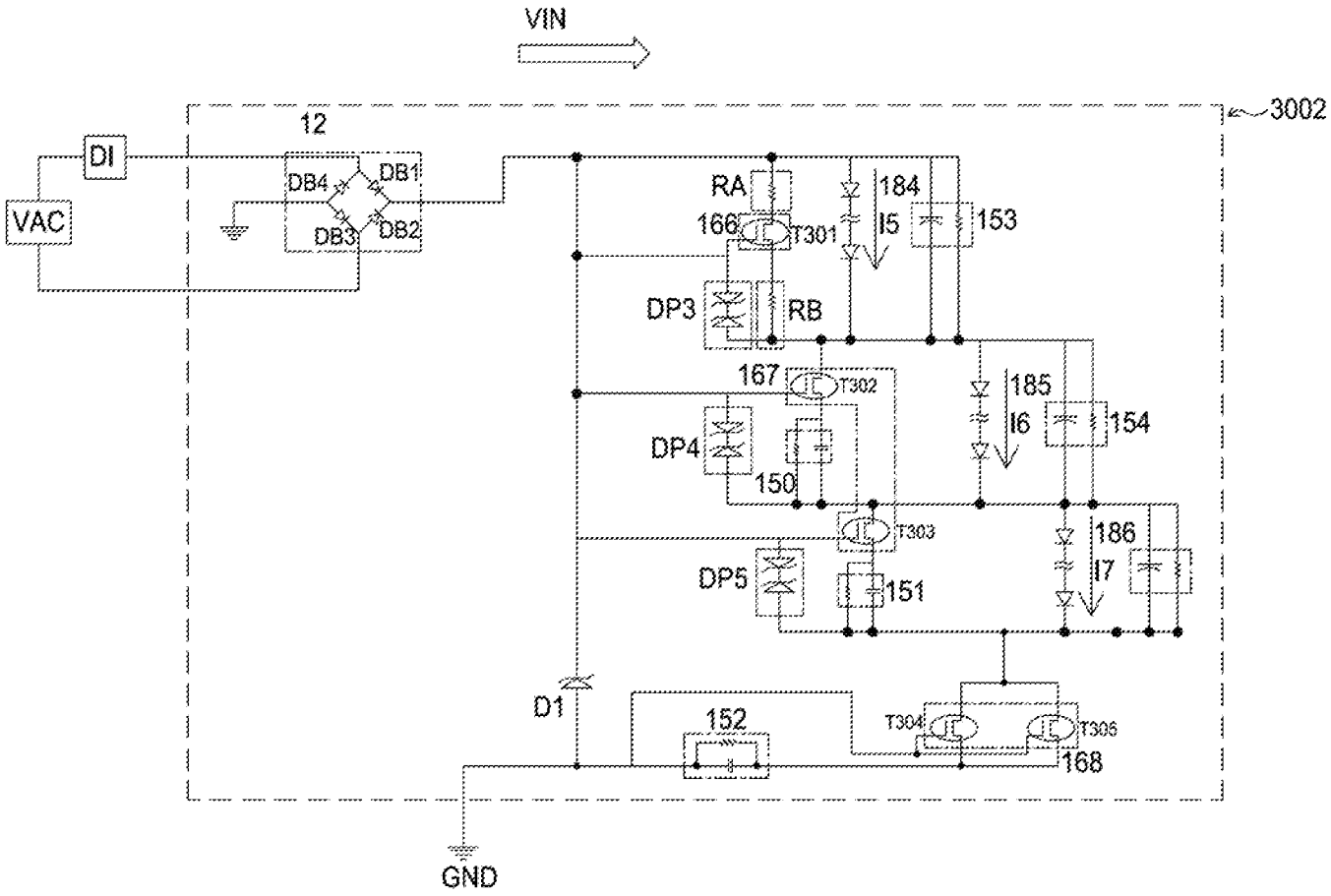
FIG. 3B is a circuit diagram of a light-emitting device in accordance with an embodiment of the present disclosure.

FIG. 3A is a circuit diagram of a light-emitting device in accordance with an embodiment of the present disclosure. Referring to FIG. 3A, the light-emitting device 3000 includes a driving circuit 300 and light sources 184-186 having light-emitting diodes. The light sources 184-186 can be formed by connecting a plurality of light-emitting diodes of the same or different sizes in series. The light sources 184-186 can also be a filament or a light source having endurance for high voltage. The related detailed descriptions can be referred to the above-mentioned paragraphs. In an embodiment, the light-emitting device 3000 is a light-emitting device adapting DOB (Driver On Board) technology with both the driving circuit 300 and the light sources 184-186 disposed on the same board. The driving circuit 300 includes a bridge rectifier 12, filters 150-152, electronic devices 166-168 having high electron mobility transistors, diode D1, resistors RA and RB, and diode groups DP3-DP5. The electronic devices 166-168 are similar to the electronic device 16, and are used as a current source to provide current to the light sources 184-186. The electronic device 166 includes a transistor T301, the electronic device 167 includes transistors T302 and T303, and the electronic device 168 includes a transistor T304. FIG. 3B is a circuit diagram of a light-emitting device 3002 in accordance with an embodiment of the present disclosure. In FIG. 3B, the electronic devices 166-168 of FIG. 3A are replaced by transistors to form the light-emitting device 3002. For example, the electronic device 166 is replaced by a transistor T301, the electronic device 167 is replaced by transistors T302 and T303, and the electronic device 168 is replaced by transistors T304 and T305. The bridge rectifier 12 converts the power supply VAC into an input voltage VIN. The related detailed descriptions can be referred to the above-mentioned paragraphs. A fixed voltage existing between the two terminals of the diode D1 in the breakdown condition is provided to the electronic devices 166 and 167. In an embodiment, the diode D1 is a Zener diode.

Referring to FIG. 3A, the light-emitting device 3000 is electrically connected to the power supply VAC and a dimmer DI. The dimmer DI can adjust the luminous intensity of the light-emitting device 3000 by changing the electrical signal into the light-emitting device 3000, wherein the dimmer DI is a TRIAC dimmer. In an embodiment, the light-emitting device 3000 is electrically connected to a digital dimmer and a power supply. After receiving an input signal, the dimmer DI changes the waveform of the signal by cutting off part of the input signal, and then outputs the remaining waveform to change a signal received by the load end. For example, after receiving a sine wave (for example, an AC signal), taking phase angle of 0 to 180 degrees for consideration, the dimmer DI cuts off the phase angle of the sine wave from 0 to 90 degrees, so that the waveform output from the dimmer DI only retains the phase angle of the sine wave from 90 degrees to 180 degrees. Therefore only half of the energy of the sine wave can pass through the dimmer DI. The dimmer DI further includes a minimum current for maintaining operation. It can prevent the current passed through the light-emitting device 3000 from being lower than the minimum current for maintaining the operation when the light-emitting device 3000 is at low luminance, which makes the dimmer DI abnormally turned off causing the light-emitting device 3000 flickering. The driving circuit 300 includes a bleeder circuit to generate a latching current for the dimmer DI. The bleeder circuit includes electronic devices 166-168 and filters 150-152. When the voltage supplied by the power supply VAC is low, and the light sources 184-186 have not yet illuminated and only a very low current passes through the dimmer DI, the bleeder circuit is electrically connected to the dimmer DI and provides a latching current. More particularly, a latching current flows through the dimmer DI, the bridge rectifier 12, the resistor RA, the electronic device 166, the resistor RB, the electronic device 167, the filters 150 and 151, the electronic device 168 and the filter 152, wherein the electronic device 166-168 is used as the current source and the resistor RA and RB are connected in series with the electronic devices 166-168 for adjusting the current. In an embodiment, the bleeder circuit is used as a current source.

As the value of the power supply VAC increases, the input voltage VIN also increases and the light sources 184-186 are sequentially illuminated. In particular, referring to FIGS. 3A, 3B, the input voltage VIN is increased sufficiently to turn on the light source 184 but the light sources 185 and 186 are not illuminated. At this time, the electronic device 166 is turned off. The current I5 flows through the light source 184, the transistor T302 of the electronic device 167, the filter 150, the transistor T303 of the electronic device 167, the filter 151, the electronic device 168 and the filter 152. As the input voltage VIN increases again, the transistor T302 of the electronic device 167 and the electronic device 166 are turned off and the light sources 184, 185 are illuminated but the light source 186 is not illuminated. At this time, the current I6 flows through the light sources 184 and 185, the transistor T303 of the electronic device 167, the filter 151, the electronic device 168, and the filter 152. The input voltage VIN is then increased to turn off the electronic devices 166 and 167, and the electronic device 168 remains turned on. The light sources 184-186 are illuminated and the current I7 flows through the light sources 184-186, the electronic device 168, and the filter 152.

When the input voltage VIN gradually decreases, the electronic devices 167 and 166 are sequentially turned on in the reverse order of the above-mentioned description about the input voltage VIN being gradually increased. For example, the electronic device 167 is turned on and then the electronic device 166 is turned on. During the illuminating process of the light sources 184-186, the transistors of the electronic devices 167-168 provide current and limit the maximum value of the passing current, thereby preventing the light sources 184-186 from receiving excessive current and being damaged. During the operation, the electronic device 167 (the transistors T302 and T303), and the electronic device 168 (the transistors T304 and T305) act as part of the bleeder circuit for passing the latching current when the light sources 184-186 are not turned on, and as a current source when the light sources 184-186 are illuminated. The related descriptions can be referred to the above-mentioned paragraphs of FIG. 3A.

Figure 3C:
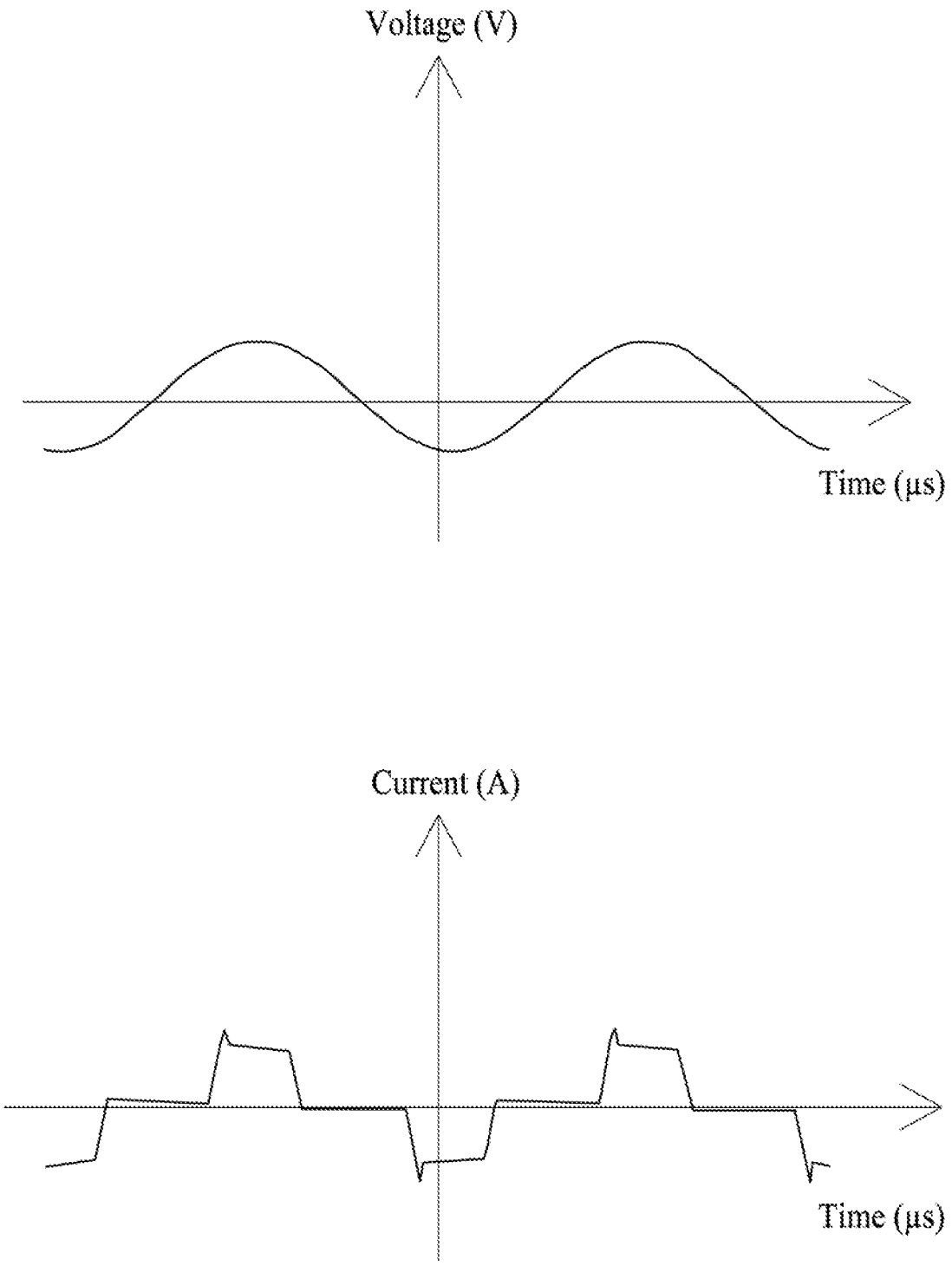
FIGS. 3C to 3E are waveform diagrams of a light-emitting device under different operation conditions in accordance with an embodiment of the present disclosure.
Figure 3D:
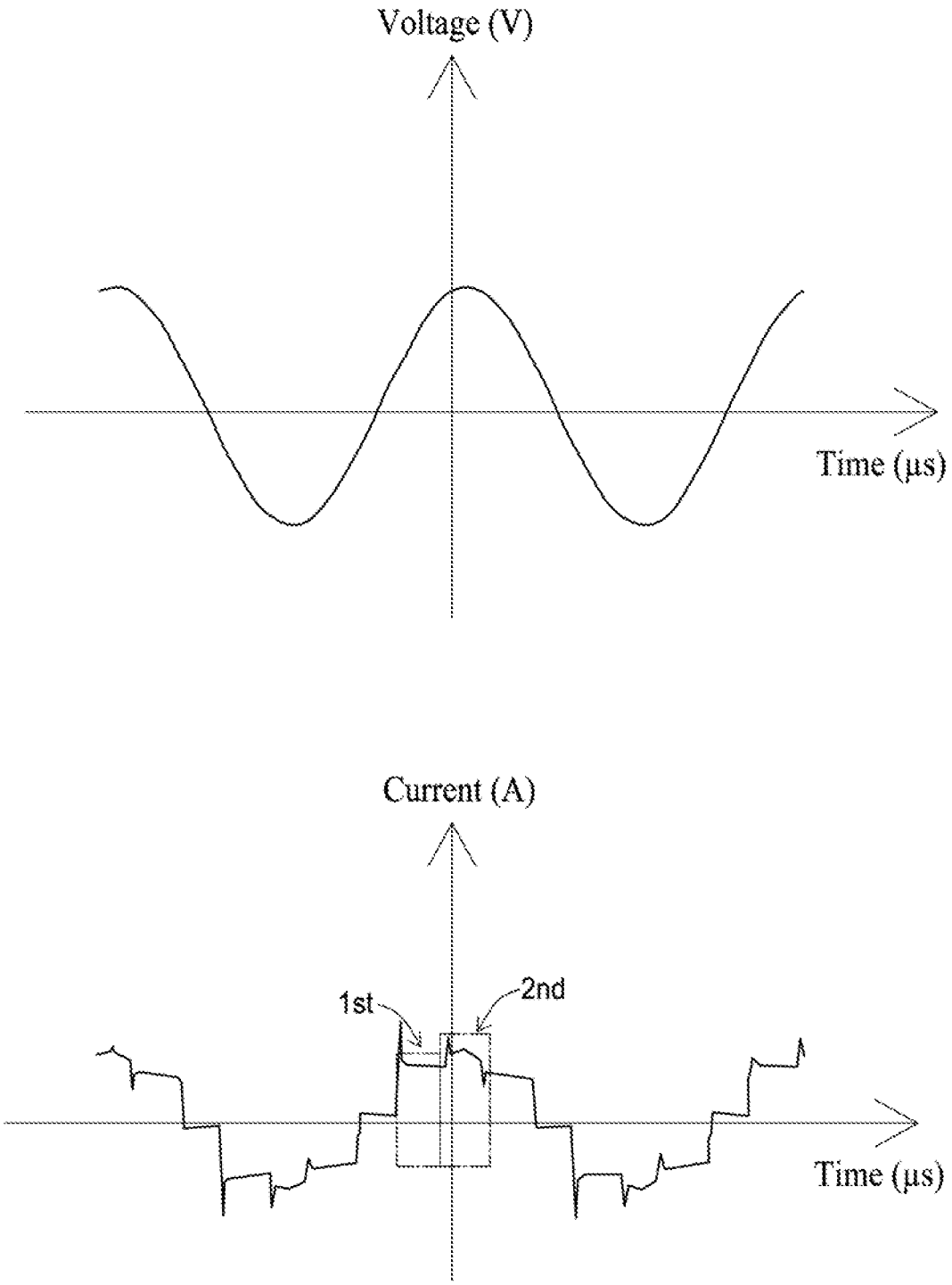
Figure 3E:
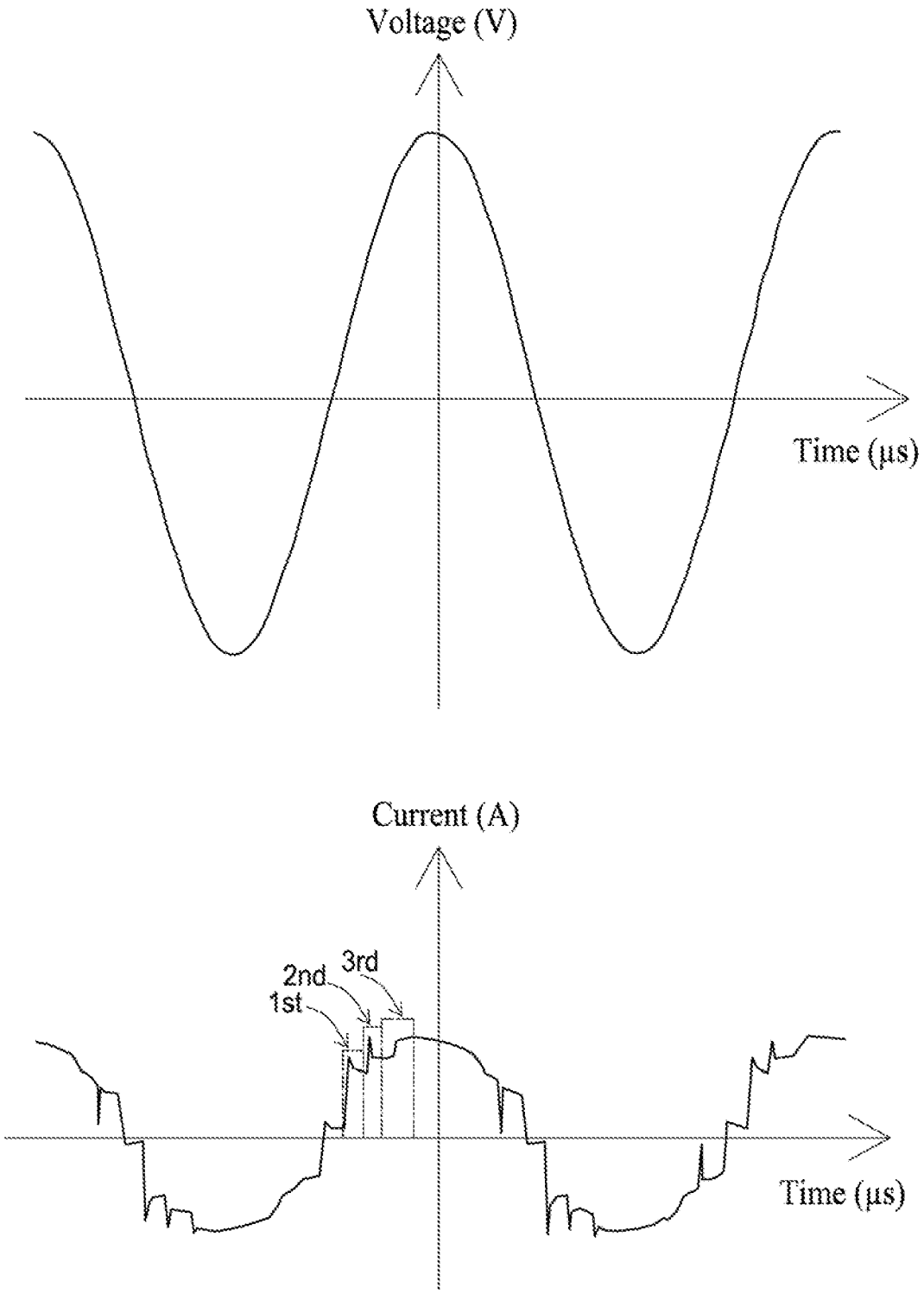

FIGS. 3C to 3E are waveform diagrams of a light-emitting device under different operation conditions in accordance with an embodiment of the present disclosure. These operation conditions are differentiated by the different input conditions changed by the dimmer DI. More particularly, FIGS. 3C to 3E show the waveforms of a transient state when the light-emitting device of FIG. 3A or 3B is operated under different input conditions.

Referring to FIG. 3C, the RMS value of the voltage output from the power supply VAC is 50V, and the average output current is 24.3 mA. In FIG. 3C, the left-hand side diagram is the voltage waveform diagram and the right-hand side diagram is the current waveform diagram. Under the operation condition of FIG. 3C, only the light source 184 emits light and the light sources 185 and 186 are not illuminated. At this time, the electronic device 166 is turned off and the current I5 flows through the light source 184, the transistor T302 of the electronic device 167, the filter 150, the transistor T303 of the electronic device 167, the filter 151, the electronic device 168, and the filter 152.

Referring to FIG. 3D, the RMS value of the voltage output from the power supply VAC is 120V, and the average output current is 35.2 mA. In FIG. 3D, the left-hand side diagram is the voltage waveform diagram and the right-hand side diagram is the current waveform diagram. Under the operation condition of FIG. 3D, the light sources 184 and 185 emit light. At this time, the electronic device 166 and the transistor T302 of the electronic device 167 are turned off. The current I6 flows through the light sources 184 and 185, the transistor T303 of the electronic device 167, the filter 151, the electronic device 168 and the filter 152. In the process of increasing the voltage of power supply VAC from 0V to 120V, it goes through the voltage 50V disclosed in FIG. 3C first. Therefore, in the current waveform diagram, the 1st area in FIG. 3D indicates the current under the condition disclosed in FIG. 3C and the 2nd area indicates the current under the condition disclosed in FIG. 3D.

Referring to FIG. 3E, the RMS value of the voltage output from the power supply VAC is 230V, and the average output current is 46 mA. In FIG. 3E, the left-hand side diagram is the voltage waveform diagram and the right-hand side diagram is the current waveform diagram. Under the operation condition of FIG. 3E, the light sources 184-186 emit light. At this time, the electronic devices 166 and 167 are turned off. The current I7 flows through the light sources 184 and 185, the electronic device 168 and the filter 152. In the process of increasing the voltage of power supply VAC from 0V to 230V, it goes through the voltage 50V disclosed in FIG. 3C and the voltage 120V disclosed in FIG. 3D first. Therefore, in the current waveform diagram, the 1st area in FIG. 3E indicates the current under the condition disclosed in FIG. 3C, the 2nd area indicates the current under the condition disclosed in FIG. 3D and the 3rd area indicates the current under the condition disclosed in FIG. 3E. In contrast, when the voltage output from the power supply VAC decreases, the light source and the electronic devices are turned off in the reverse order of the above-mentioned description about the voltage of the power supply VAC being increasing. The related descriptions can be referred to the above-mentioned paragraphs of FIG. 3A.

In general, the operation state of the light-emitting devices 3000, 3002 are varied with the voltage output from the power supply VAC. An operation state corresponding to a higher voltage output from the power supply VAC must be accompanied with an operation state corresponding to a lower voltage. For example, when observing the waveform of the 75V RMS value of the voltage output from the power supply VAC, the waveform of the 50V RMS value of the voltage output from the power supply VAC in FIG. 3C and the waveform of the 120V RMS value of the voltage output from the power supply VAC in FIG. 3D can also be observed. However, when the light-emitting devices 3000 and 3002 do not emit light, for example, when the voltage output from the power supply VAC is 40V, the bleeder circuit provides a latching current through the dimmer DI. The related descriptions can be referred to paragraphs of FIG. 2F.

Figure 4A:
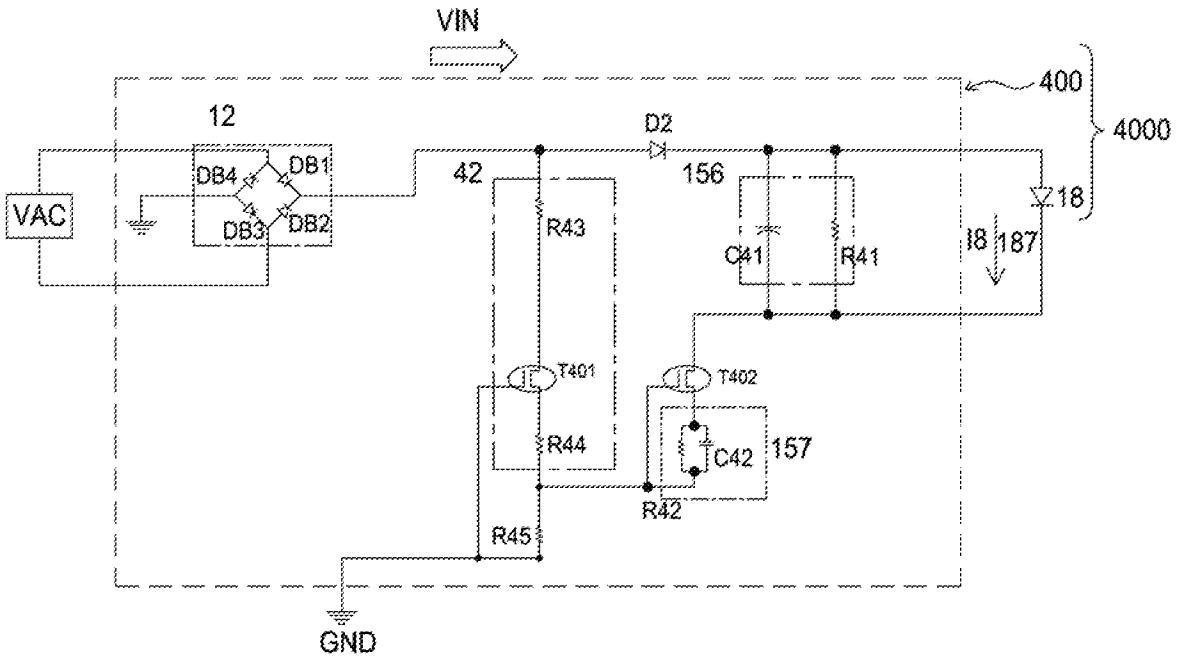
FIG. 4A is a circuit diagram of a light-emitting device in accordance with an embodiment of the present disclosure.

FIG. 4A is a circuit diagram of a light-emitting device in accordance with an embodiment of the present disclosure. Referring to FIG. 4A, the light-emitting device 4000 includes a driving circuit 400 and a light source 187 having light-emitting diodes. The light source 187 can be formed by connecting a plurality of light-emitting diodes of the same or different sizes in series. The light source 187 can also be a filament or a light source having endurance for high voltage. The related detailed descriptions can be referred to the above-mentioned paragraph. In an embodiment, the light-emitting device 4000 is a light-emitting device adapting DOB (Driver On Board) technology with both the driving circuit 400 and the light source 187 disposed on the same board. The driving circuit 400 includes a bridge rectifier 12, a bleeder circuit 42 having a transistor T401, a diode D2, a resistor R45, filters 156 and 157, and a transistor T402.

The transistors T401 and T402 can be high electron mobility transistors, and the transistor T402 is used as current sources for the light source 187. When the transistor T402 is activated, the transistor T402 generates a substantially constant current flow to the light source 187 and the value of the current is almost not changed under the variation of the voltage difference between the drain and the source. Therefore, the transistor T402 can provide a constant current to the light source 187. The bridge rectifier 12 is used to convert the power supply VAC into an input voltage VIN. The related descriptions can be referred to the above-mentioned paragraphs. The filter 156 is located between the light source 187 and the bleeder circuit 42. The filter 156 is connected to the bridge rectifier 12 through the diode D2, and includes a resistor R41 and a capacitor C41 connected in parallel. The filter 157 connected to the transistor T402 includes a resistor R42 and a capacitor C42 connected in parallel.

The bleeder circuit 42 includes a transistor T401 and resistors R43, R44. The resistor R43 is located between the bridge rectifier 12 and the transistor T401. The resistor R43 is located between the transistor T401 and the resistor R45. The resistors R43-R45 are used to adjust the current value of the bleeder circuit 42. In an embodiment, the light-emitting device 4000 does not include the resistor R45. The transistor T401 is further electrically connected to the transistor T402 through the resistor R42. In particular, the source of the transistor T401 is connected to the gate of the transistor T402, the source of the transistor T401 is connected to the source of the transistor T402 through the filter 157, and the drain of the transistor T401 is connected to the drain of the transistor T402 through the filter 156 so that the transistor T401 and the transistor T402 can be considered as being connected in parallel. When the bleeder circuit 42 can be turned on or turned off by an external control signal, it can be used as an active bleeder circuit. In an embodiment, the power supply VAC is used as an external control signal, the transistor T401 is a depletion mode transistor, and the gate of the transistor T401 is connected to ground as shown in FIG. 4A to make the transistor T401 turned on. As the voltage of the power supply VAC increases, the current flowing through the bleeder circuit 42 also increases so that the current I8 flowing through the light source 187 increases. The current I8 also flows through the resistor R45. As the current I8 increases, the terminal voltage of the resistor R45 connected to the bleeder circuit 42 also increases, which means that the source voltage of the transistor T401 increases. When the voltage difference between the gate and the source of the transistor T401 increases to a certain value, that is, when the voltage difference between the gate and the source is greater than the threshold voltage of the transistor T401, it causes the depletion mode transistor T401 to be turned off. The bleeder circuit 42 is also turned off and no current flowing. In an embodiment, the bleeder circuit 42 is used as a current source.

Figure 4B:
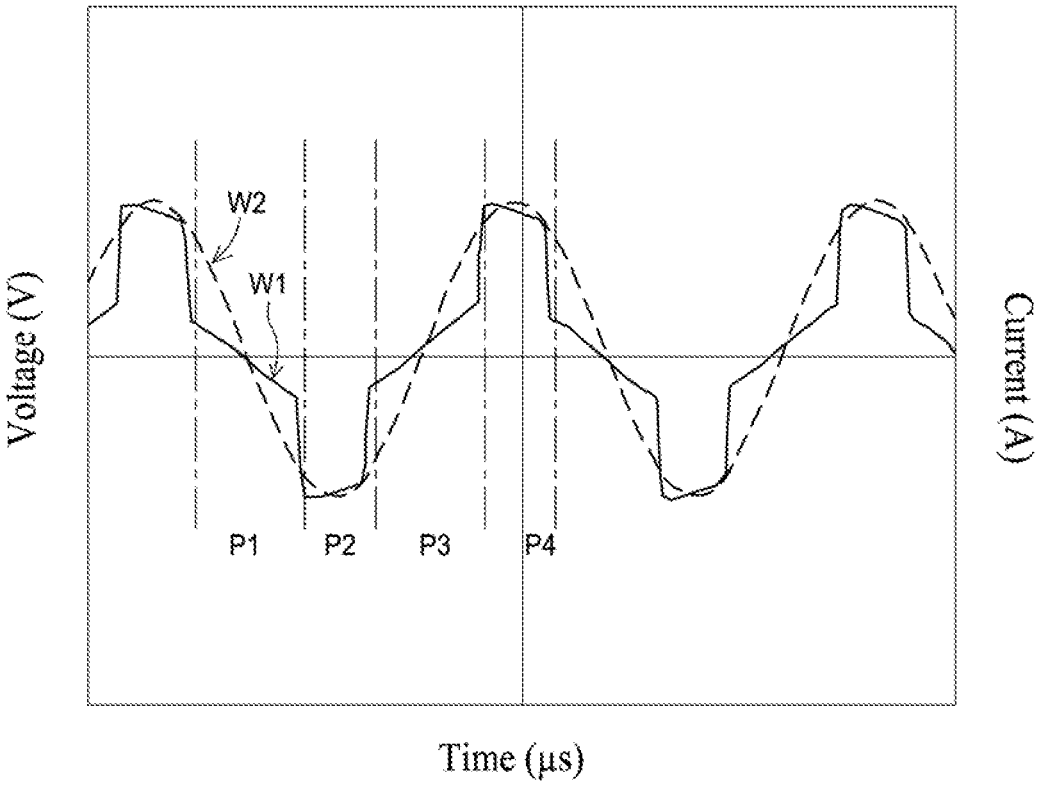
FIGS. 4B-4D are the waveform diagrams of different terminals in a light-emitting device in accordance with an embodiment of the present disclosure.
Figure 4C:
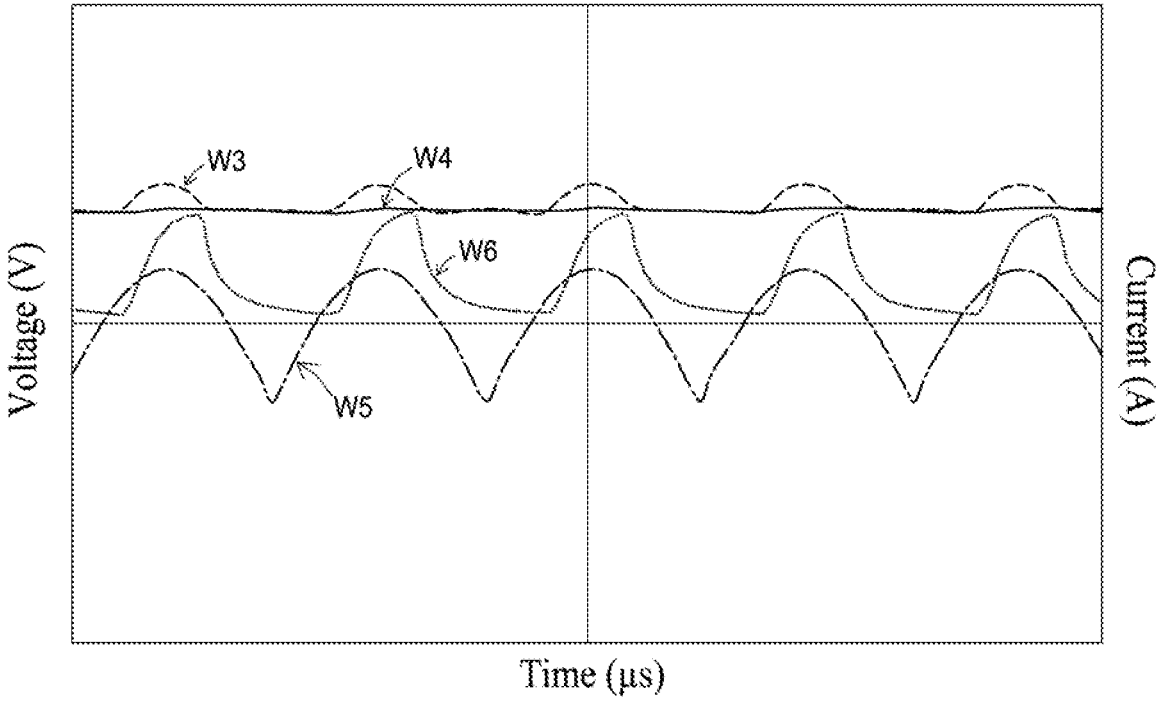
Figure 4D:
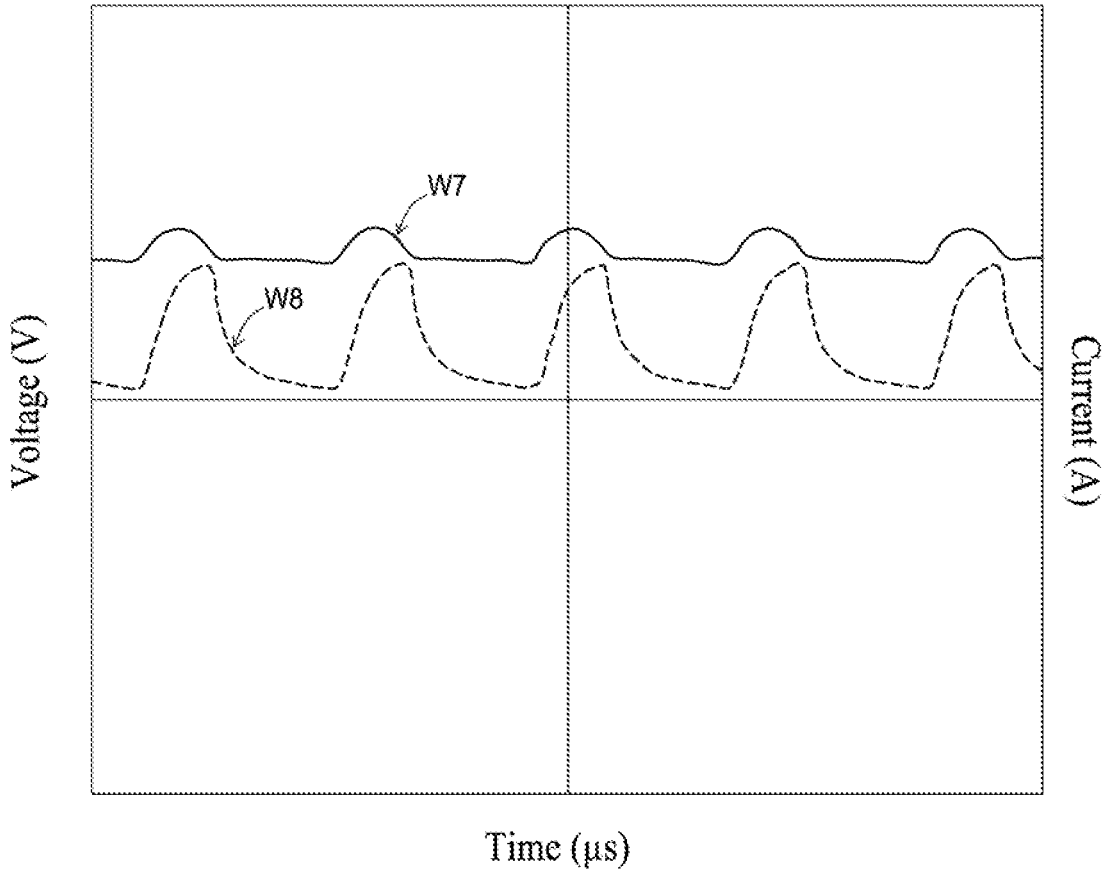

FIGS. 4B-4D are the waveform diagrams of different terminals in a light-emitting device in accordance with an embodiment of the present disclosure. FIG. 4B shows the current waveform W1 and the voltage waveform W2 provided by the power supply VAC, wherein the current waveform W1 has a RMS value of 51.7 mA and the voltage waveform W2 has a RMS value of 121V. FIG. 4B can be divided into four parts P1-P4. The phases of the parts P1 and P3 show that the voltage of the power supply VAC is insufficient to turn off the transistor T401, and the bleeder circuit 42 is activated. At the phase when the bleeder circuit 42 is activated, the current supplied by the power supply VAC is primarily dominated by the current flowing through the bleeder circuit 42 and a small portion of the current flowing to the light source 187. However, these currents are not enough to activate the light source 187. In an embodiment, during the phase that the bleeder circuit 42 is activated, the current supplied by the power supply VAC is all dominated by the current flowing through the bleeder circuit 42. The phases of parts P2 and P4 show that the voltage of the power supply VAC is sufficient to turn off the transistor T401 and activate the light source 187. At this time, the bleeder circuit 42 is turned off, and the current supplied by the power supply VAC is primarily dominated by the current flowing through the light source 187 and only a small portion is by the current flowing to the bleeder circuit 42, but it is still insufficient to activate the bleeder circuit 42. In other words, the current flows mainly to the bleeder circuit 42 when the voltage supplied by the power supply VAC is low, and flows to the light source 187 when the voltage is high, thereby avoiding excessive current flow to light source 187 when the voltage is low. When the voltage supplied by the power supply VAC is low, excessive current flowing to light source 187 can produce blinking or low luminance condition that is considered abnormal.

FIG. 4C shows the waveform W3 of the voltage across the filter 156, the waveform W4 of the voltage across the light source 187, the waveform W5 of the voltage across the bleeder circuit 42 and the waveform W6 of the current I8. The waveform W3 has a RMS value of 138V, the waveform W4 has a RMS value of 132V, the waveform W5 has a RMS value of 120V, and the waveform W6 has a RMS value of 31.3 mA. The waveform W4 is smoother than the waveform W3. This is because the voltage of the power supply VAC passes through the filter 156 having the voltage regulation function before entering the two terminals of the light source 187, so that the light source 187 can receive a relatively smooth voltage (waveform W4). This makes the light source provide a stable light intensity while receiving a stable voltage. As in the operation flow described in the above-mentioned paragraphs, the bleeder circuit 42 is activated when the voltage supplied by the power supply VAC is low, and then the light source 187 is activated as the voltage increases. Therefore, the peak of the waveform W5 of the voltage across the bleeder circuit 42 appears before the peak of the waveform W6 of the current I8, that is, the normal operation of the bleeder circuit 42.

FIG. 4D shows the waveform W8 of the voltage across the light source 187 and the waveform W8 of the current I8. The waveform W7 has a RMS value of 138V and the waveform W8 has a RMS value of 31.3 mA. The peaks and troughs of the waveform W7 and the waveform W8 are appeared corresponding to each other.

In an embodiment, the light-emitting device 4000 is connected to a dimmer DI to adjust the luminance of the light source 187 through the dimmer DI as shown in FIG. 3A. The bleeder circuit 42 can provide a latching current to dimmer DI, such as the phases P1 and P3 in FIG. 4B, to avoid abnormal flicker or low-luminance.

Figure 5A:
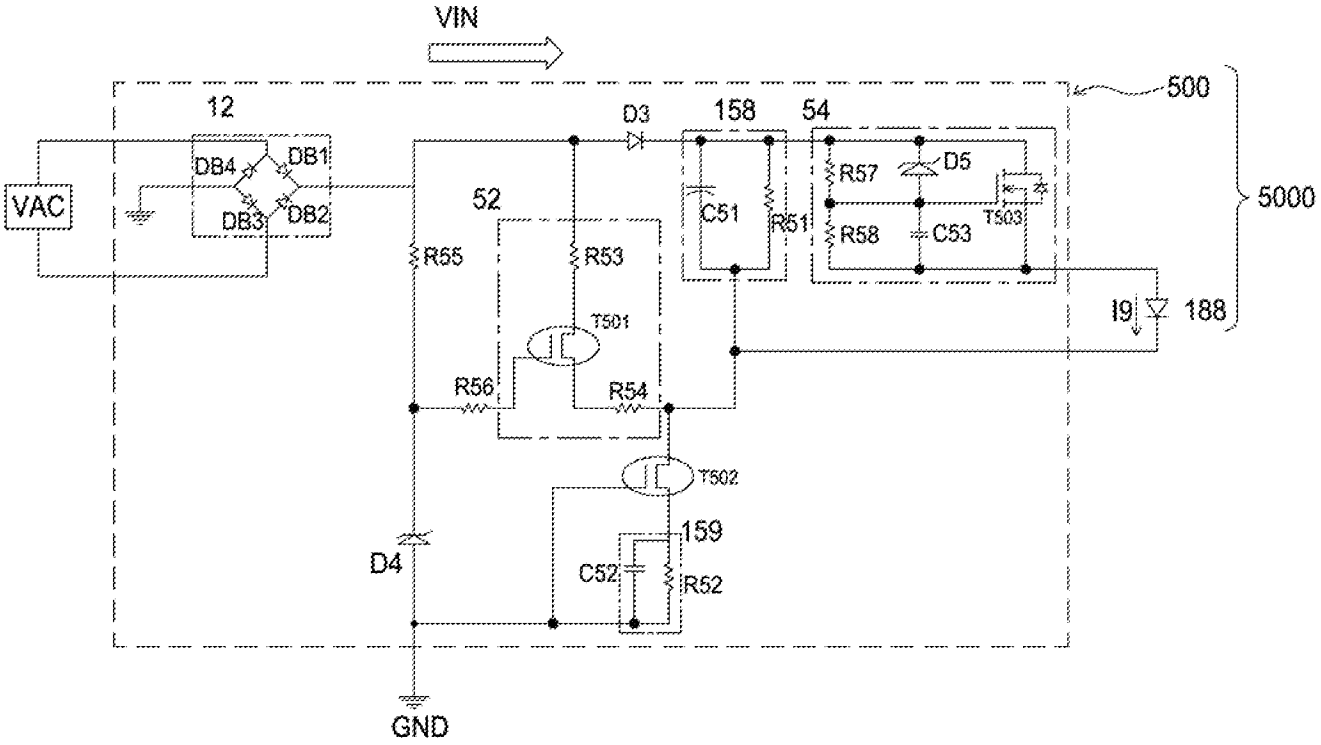
FIG. 5A is a circuit diagram of a light-emitting device in accordance with an embodiment of the present disclosure.

FIG. 5A is a circuit diagram of a light-emitting device in accordance with an embodiment of the present disclosure. Referring to FIG. 5A, the light-emitting device 5000 includes a driving circuit 500 and a light source 188 having light-emitting diodes. The light source 188 can be formed by connecting a plurality of light-emitting diodes of the same or different sizes in series. The light source 188 can also be a filament or a light source having endurance for high voltage. The related detailed descriptions can be referred to the above-mentioned paragraph. In an embodiment, the light-emitting device 5000 is a light-emitting device adapting DOB (Driver On Board) technology with both the driving circuit 500 and the light source 188 disposed on the same board. The driving circuit 500 includes a bridge rectifier 12, a bleeder circuit 52 having a transistor T501, diodes D3 and D4, resistors R55 and R56, filters 158 and 159, a transistor T402, and a flicker reduction circuit 54. The flicker reduction circuit 54 is regarded as a stabilizing-current circuit which can stabilize the current, thereby avoiding the light flicker caused by current vibration.

The transistors T501 and T502 can be high electron mobility transistors, and the transistor T502 is used as current sources for the light source 188. When the transistor T502 is activated, the transistor T502 generates a substantially constant current flow to the light source 188 and the value of the current is almost not changed under the variation of the voltage difference between the drain and the source. Therefore, the transistor T502 can provide a constant current to the light source 188. The bridge rectifier 12 is used to convert the power supply VAC into an input voltage VIN. The related descriptions can be referred to the above-mentioned paragraphs. The filter 158 is located between the light source 188 and the bleeder circuit 52. The filter 158 is connected to the bridge rectifier 12 through the diode D3, and includes a resistor R51 and a capacitor C51 connected in parallel. The filter 159 connected to the transistor T502 includes a resistor R52 and a capacitor C52 connected in parallel.

The bleeder circuit 52 includes a transistor T501 and resistors R53, R54. The resistor R53 is located between the bridge rectifier 12 and the transistor T501. The resistor R54 is located between the transistor T501 and the transistor T502. The resistors R53 and R54 are used to adjust the current value of the bleeder circuit 52. The bleeder circuit 52 is connected with the transistor T502 in series. When the light source 188 has not been activated, the current supplied by the bleeder circuit 52 flows through the transistor T502 and the filter 159. Therefore, the current flowing through the bleeder circuit 52 is also limited by the transistor T502. For example, the maximum value of the current flowing through the bleeder circuit 52 cannot exceed the maximum value of the current that the transistor T502 can withstand, and the current flowing through the bleeder circuit 52 cannot exceed the current flowing through the transistor T502. The gate of the transistor T501 is connected to the resistor R55 via a resistor R56 and a diode D4 connected in series. When the diode D4 is turned on, a stable voltage is applied to the gate of the transistor T501 through a fixed voltage across two terminals of the diode D4. As the voltage of the power supply VAC increases, the voltage received by the source of the transistor T501 through the resistor R54 also increases until the transistor T501 is turned off to close the bleeder circuit 52. In an embodiment, the bleed circuit 52 can be used as an active bleed circuit. The voltage of the power supply VAC can be a control signal to turn the bleed circuit 52 on or off. The related descriptions can be referred to the above-mentioned paragraphs of FIG. 4A. In an embodiment, the bleeder circuit 52 is used as a current source.

The two terminals of the flicker reduction circuit 54 are respectively connected to the filter 158 and the light source 188. The flicker reduction circuit 54 includes resistors R57 and R58, a capacitor C53, a diode D5 and a transistor T503. The transistor T503 can be a high electron mobility transistor or a Metal-Oxide-Semiconductor Field-Effect Transistor (MOSFET). The diode D5 can be a Zener diode. The voltage received by the gate of transistor T503 is determined by the voltage division of resistors R57 and R58, or by the voltage across the diode D5. The capacitor C53 is used to store the charge to stabilize the voltage of the gate of transistor T503. When the voltage of the power supply VAC increases, the voltage between the resistors R57 and R58 increases, and the voltage received by the gate of the transistor T503 also increases. Until the voltage between the resistors R57 and R58 increases enough to cause the breakdown of the diode D5, the voltage received by the gate of the transistor T503 is fixed at the breakdown voltage of the diode D5. For example, when the diode D5 receives a voltage greater than or equal to its breakdown voltage, the voltage across the diode D5 is fixed at a constant value. That is, the breakdown of the diode D5 causes the transistor T503 to operate within a fixed voltage range, so that the current through the transistor T503 is substantially fixed. For example, when the diode D5 is broken down, the difference between the maximum value and the minimum value of the current through the transistor T503 is less than 5% of the minimum value, and the capacitor C53 can further reduce the variation of the current, thereby stabilizing the current I9 to avoid the light flicker caused by peak vibration of the high voltage. In other words, the flicker reduction circuit 54 can avoid the variation of the current I9 caused by the variation of the power supply VAC, thereby avoiding the light flicker from the light source 188 caused by the variation of the current I9.

For example, the voltage of the power supply VAC is 110V, the activation voltage of the light source 188 is 80V, the breakdown voltage of the light source is 120V, and a diode D5 with a breakdown voltage of 18V is selected. The flicker reduction circuit 54 can be designed to be activated by turning on the transistor T503 when the voltage of the power supply VAC reaches 98V (the sum of the activation voltage (80V) of the light source 188 and the breakdown voltage (18V) of the diode D5), wherein the current is the maximum value of current I9. In another embodiment, the flicker reduction circuit 54 can be designed to be activated when the voltage of the power supply VAC reaches 138V (the sum of the breakdown voltage (120V) of the light source 188 and the breakdown voltage (18V) of the diode D5), wherein the current is the maximum value of current I9. By setting the diode D5, the voltage fluctuation to the drain of the transistor T503 is not directly reflected on the light source 188 so as to reduce the ripple of the current I9 to the light source 188 for avoiding abnormal flicker caused by the ripple. The flicker reduction circuit 54 can also be applied and connected to the light source of other light-emitting devices, such as the light-emitting devices 1000, 2000, 2002, 3000, 3002, 4000, to reduce the ripple of the current to the light source.

Figure 5B:
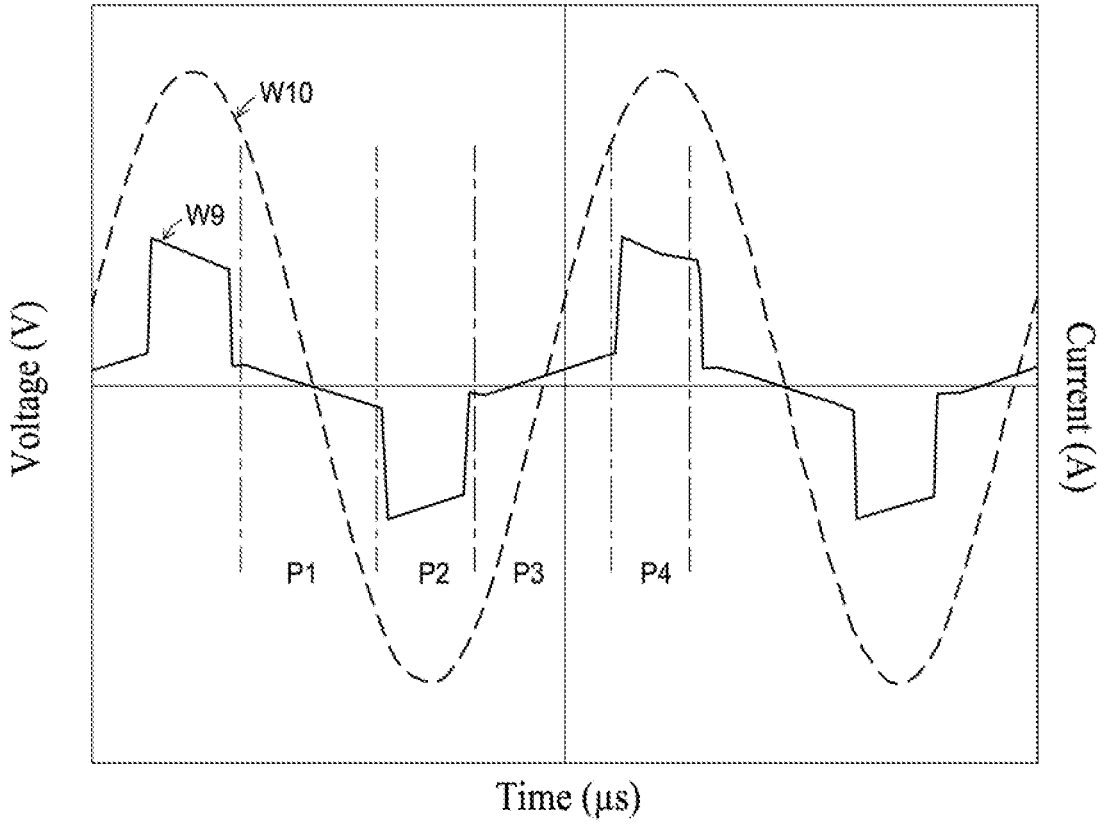
FIGS. 5B-5C are the waveform diagrams of different terminals in a light-emitting device in accordance with an embodiment of the present disclosure.
Figure 5C:
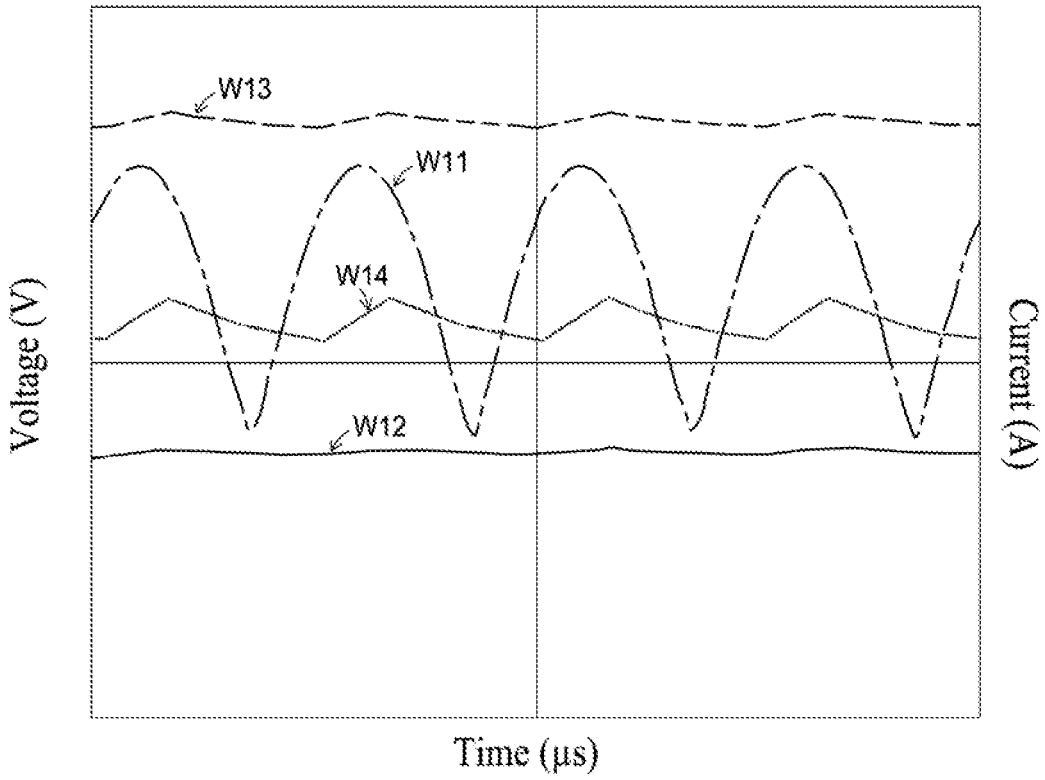

FIGS. 5B-5C are the waveform diagrams of different terminals in a light-emitting device in accordance with an embodiment of the present disclosure. FIG. 5B shows the current waveform W9 and the voltage waveform W10 provided by the power supply VAC, wherein the current waveform W9 has a RMS value of 40.6 mA and the voltage waveform W2 has a RMS value of 230V. FIG. 5B is similar with FIG. 4B, the voltage waveform W10 can be divided into four parts P1-P4 according to ON/OFF of the transistor T501. The phases of the parts P1 and P3 show that the transistor T501 is turned on and the bleeder circuit 42 is activated. The current supplied by the power supply VAC is primarily dominated by the current flowing through the bleeder circuit 52. The phases of parts P2 and P4 show that the transistor T501 is turned off and the light source 188 is activated. The current supplied by the power supply VAC is primarily dominated by the current flowing through the light source 188 so excessive current flowing to light source 187 when the voltage is low can be avoided. When the voltage supplied by the power supply VAC is low, excessive current flowing to light source 188 can produce blinking or low luminance condition that is considered abnormal. The related description can be referred to the above-mentioned paragraphs of FIG. 4A.

FIG. 5C shows the voltage waveform W11 of the terminal connected to the bleeder circuit 52 and the diode D3, the waveform W12 of the voltage received by the gate of the transistor T503, the waveform W13 of the voltage across the light source 188 and the waveform W13 of the current I9. The waveform W11 has a RMS value of 228V, the waveform W12 has a RMS value of 1.72V, the waveform W13 has a RMS value of 260V, and the waveform W14 has a RMS value of 17.2 mA. The bleed circuit 52 is activated when the voltage supplied by the power supply VAC is low, and then the light source 188 is activated as the voltage increases. Therefore, the peak of the waveform W11 appears before the peak of the waveform W14 and the peak of the waveform W13. That is the normal operation of the bleeder circuit 42. The waveform W12 is smoother than other waveforms. That means the gate of the transistor T503 is biased with a stable voltage because of the combination of the diode D5 and the capacitor C53, thereby reducing the ripple of the current to the light source 188. As the voltage of the power supply VAC increases, the bleeder circuit 52 is activated before the light source 188 and the light source 188 is activated before the flicker reduction circuit 54.

In an embodiment, the light-emitting device 5000 is connected to a dimmer DI to adjust the luminance of the light source 188 through the dimmer DI as shown in FIG. 3A. The bleeder circuit 42 can provide a latching current to dimmer DI, such as the phases P1 and P3 in FIG. 5B, to avoid abnormal flicker or low-luminance.

Figure 6:
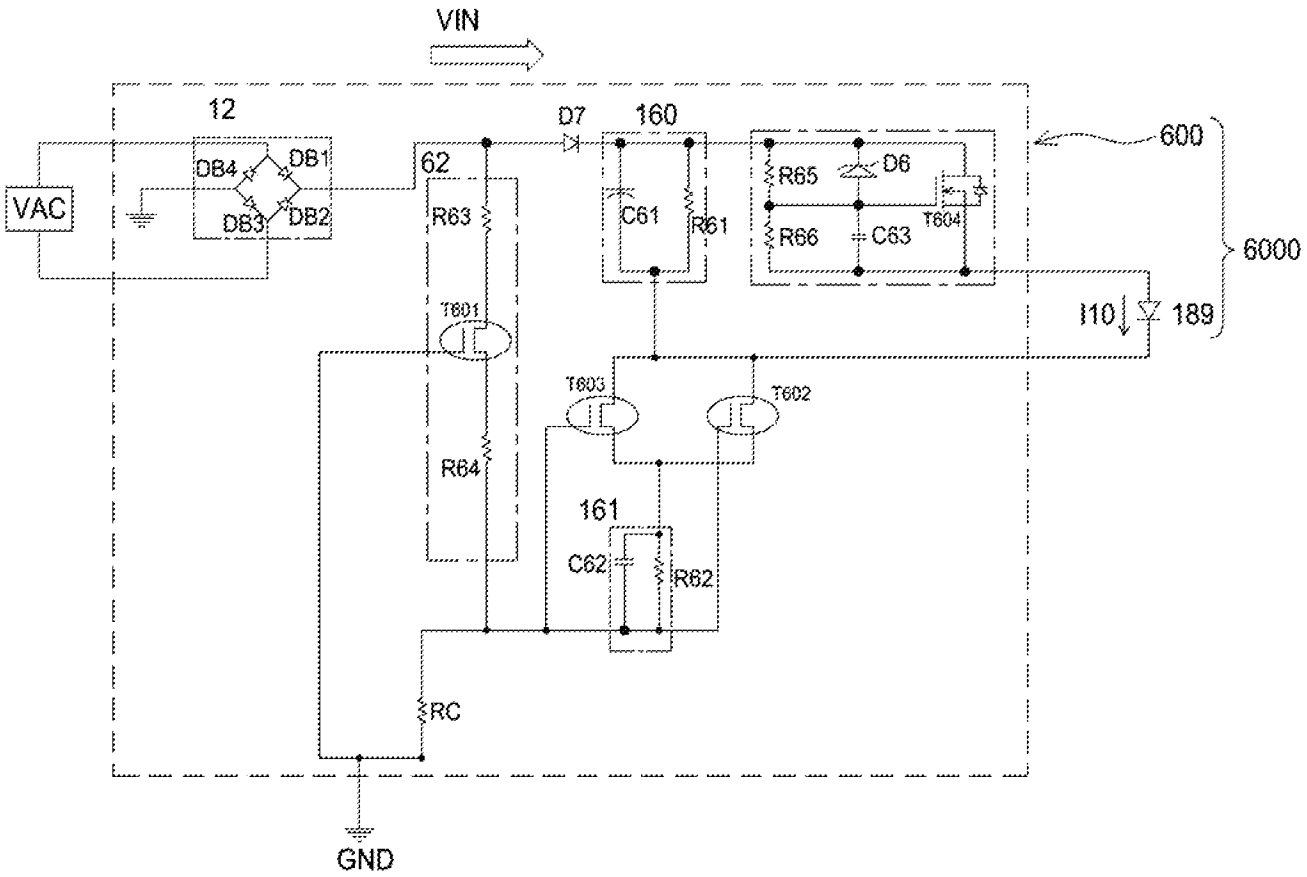
FIG. 6 is a circuit diagram of a light-emitting device in accordance with an embodiment of the present disclosure.

FIG. 6 is a circuit diagram of a light-emitting device in accordance with an embodiment of the present disclosure. Referring to FIG. 6, the light-emitting device 6000 includes a driving circuit 600 and a light source 189 having light-emitting diodes. The light source 189 can be formed by connecting a plurality of light-emitting diodes of the same or different sizes in series. The light source 189 can also be a filament or a light source having endurance for high voltage. The related detailed descriptions can be referred to the above-mentioned paragraph. In an embodiment, the light-emitting device 6000 is a light-emitting device adapting DOB (Driver On Board) technology with both the driving circuit 600 and the light source 189 disposed on the same board. The driving circuit 600 includes a bridge rectifier 12, a bleeder circuit 62 having a transistor T501, diodes D7, a resistor RC, filters 160 and 161, transistors T602 and T603, and a flicker reduction circuit 64.

The transistors T601-T503 can be high electron mobility transistors. The transistor T602 and T603 are used as current sources for the light source 189 and can be accompanied with the filter 161 to make the voltage received by the transistors T602 and T603 more stable, thereby supplying a more stable current. The bridge rectifier 12 is used to convert the power supply VAC into an input voltage VIN. The related descriptions about a constant current supplied by the transistor and the bridge rectifier 12 can be referred to the above-mentioned paragraphs. In an embodiment, the transistors T602 and T603 can be packaged in the same electronic device.

The filter 160 and the flicker reduction circuit 64 are disposed between the light source 189 and the bleeder circuit 52. The filter 160 connected to the diode D7 includes a resistor R61 and a capacitor C61 connected in parallel. The filter 161 connected to the transistors T602 and T603 includes a resistor R62 and a capacitor C62 connected in parallel.

The bleeder circuit 62 includes a transistor T601 and resistors R63 and R64 for adjusting the value of the current flowing through the bleeder circuit 62. The gate of the transistor T601 is connected to ground. As the voltage of the power supply VAC increase, the current through the resistor RC and the bleeder circuit 62 increases, and the voltage received by the source of the transistor T601 through the resistor RC also increases. The transistor T601 is turned off until the voltage of the gate and source of the transistor T601 is greater than the threshold voltage. In an embodiment, the bleeder circuit 62 can be used as an active bleeder circuit. The voltage of the power supply VAC can be a control signal to turn the bleeder circuit 62 on or off. The related descriptions about the active bleeder circuit and the bleeder circuit 62 can be referred to the above-mentioned paragraphs of FIG. 5A. In an embodiment, the bleeder circuit 62 is used as a current source.

One side of the transistors T602 and T603 is connected to the resistor RC through the filter 161, and the other side is connected to the bleeder circuit 62 through the filter 160 and the diode D5, so that the transistors T602, T603 and the bleeder circuit 62 are connected in parallel.

The two terminals of the flicker reduction circuit 64 are respectively connected to the filter 160 and the light source 189, and includes resistors R65, R66, a capacitor C63, a diode D6 and a transistor T604. The voltage received by the gate of transistor T604 is determined by the voltage division of the resistors R65 and R66, or by the voltage across the diode D6, thereby avoiding the light flicker caused by peak vibration of the high voltage. The related descriptions about the operation of the transistor T604, the diode D6, the capacitor C63 and the resistors R65, R66 in the flicker reduction circuit can be referred to in the above-mentioned paragraphs. The ripple of the current I10 to the light source 188 can be reduced by setting the flicker reduction circuit 64 to stabilize the current I10, for avoiding abnormal flicker caused by the ripple. The flicker reduction circuit 64 can also be applied and connected to the light source of other light-emitting devices, such as the light-emitting devices 1000, 2000, 2002, 3000, 3002, 4000, to reduce the ripple of the current to the light source 188. As the voltage of the power supply VAC increases, the bleeder circuit 62 is activated before the light source 189 and the light source 189 is activated before the flicker reduction circuit 64.

In an embodiment, the light-emitting device 6000 is connected to a dimmer DI to adjust the luminance of the light source 189 through the dimmer DI as shown in FIG. 3A. The bleeder circuit 62 can provide a latching current to dimmer DI, such as the phases P1 and P3 in FIG. 5B, to avoid abnormal flicker or low-luminance. The filters in the above-mentioned embodiments can provide not only the filtering function but also the function of stabilizing the voltage. The diodes in the above-mentioned embodiments also provide a function of preventing current from flowing back.

The above are only the preferred embodiments of the present disclosure, and are not intended to limit the present disclosure. Any modifications, equivalents, improvements, etc., which are included in the spirit and scope of the present disclosure, should be included in the scope of the present disclosure.

What is claimed is:

1. A light-emitting device, comprising:

a light source having a first terminal and a second terminal;

a stabilizing-current circuit connected with the first terminal, the stabilizing-current circuit including:

a high electron mobility transistor;

a capacitor; and a Zener diode having an anode connected with the capacitor, the Zener diode and the capacitor are connected with the high electron mobility transistor in parallel; and a current source connected with the second terminal, and having a second transistor connected with the light source.

2. The light-emitting device of claim 1, wherein the light source includes a filament connected with the stabilizing-current circuit and the current source in series.

3. The light-emitting device of claim 1, further comprising a filter connected with the stabilizing-current circuit.

4. The light-emitting device of claim 1, further comprising a bleeder circuit connected with the stabilizing-current circuit and the light source.

5. The light-emitting device of claim 4, wherein the bleeder circuit is connected with the stabilizing-current circuit and the light source in parallel, and is connected with the current source in series.

6. The light-emitting device of claim 4, wherein the bleeder circuit is connected with the light source through the current source.

7. The light-emitting device of claim 6, wherein the bleeder circuit is connected with the stabilizing-current circuit, the light source and the current source in parallel.

8. A light-emitting device, comprising:

a first current source activated under a first voltage;

a stabilizing-current circuit activated under a second voltage, and electrically connected with the first current source, the stabilizing-current circuit including:

a capacitor;

a Zener diode, with an anode connected to the capacitor; and a first resistor and a second resistor connected in series, wherein the first resistor and the second resistor are connected with the Zener diode and the capacitor in parallel;

a second current source electrically connected with the first current source; and a light source activated under a third voltage, and electrically connected with the stabilizing-current circuit and the second current source, wherein the first voltage is lower than the third voltage and the third voltage is lower than the second voltage.

9. The light-emitting device of claim 8, wherein the second current source includes two high electron mobility transistors connected in parallel.

10. The light-emitting device of claim 9, wherein the first current source is connected with the stabilizing-current circuit, the light source and the second current source in parallel.

11. The light-emitting device of claim 8, wherein the stabilizing-current circuit further includes a high electron mobility transistor connected with the Zener diode and the capacitor in parallel.

12. The light-emitting device of claim 8, further comprising a filter connected with second current source in series.

13. The light-emitting device of claim 12, wherein the first current source is connected with the filter and the second current source in parallel.

14. The light-emitting device of claim 8, wherein the first current source is connected with the second current source in series.

15. The light-emitting device of claim 8, wherein the first current source is closed when the light source is activated.

* * * * *